US011684155B2

(12) United States Patent
Gelber

(10) Patent No.: US 11,684,155 B2
(45) Date of Patent: Jun. 27, 2023

(54) PIVOTABLE OVERHEAD STORAGE UNIT

(71) Applicant: 143046 Canada Inc., Montréal (CA)

(72) Inventor: Eleaizer Gelber, Montreal (CA)

(73) Assignee: 143046 CANADA INC., Montreal (CA)

( * ) Notice: Subject to any disclaimer, the term of this patent is extended or adjusted under 35 U.S.C. 154(b) by 0 days.

(21) Appl. No.: 17/089,059

(22) Filed: Nov. 4, 2020

(65) Prior Publication Data

US 2021/0045527 A1 Feb. 18, 2021

Related U.S. Application Data

(63) Continuation-in-part of application No. 16/481,131, filed as application No. PCT/CA2017/050087 on Jan. 27, 2017.

(51) Int. Cl.
*A47B 46/00* (2006.01)
*A47B 51/00* (2006.01)

(52) U.S. Cl.
CPC ..... *A47B 46/005* (2013.01); *A47B 2051/005* (2013.01)

(58) Field of Classification Search
CPC . A47B 51/00; A47B 2051/005; A47B 46/005; A47B 46/00; A47B 13/081;
(Continued)

(56) References Cited

U.S. PATENT DOCUMENTS 289,570 A * 12/1883 Schuyler ..... A47B 49/002 312/328
380,490 A * 4/1888 Jewell ..... A47B 88/48 312/298

(Continued)

FOREIGN PATENT DOCUMENTS

DE 4223048 1/1994
EP 1925236 A 5/2008

(Continued)

OTHER PUBLICATIONS

Extended European Search Report for EP application No. 17893588.8 dated Aug. 7, 2020.

(Continued)

*Primary Examiner* — Hiwot E Tefera
(74) *Attorney, Agent, or Firm* — Norton Rose Fulbright Canada LLP

(57) ABSTRACT

An overhead storage unit includes a pivot arm extending from a first end to a second end. The first end is pivotably mountable to a fixed pivot and the pivot arm is pivotable about a pivot axis defined by the pivot. A storage container having interconnected walls defines a storage container interior. One of the interconnected walls is a conforming wall. The storage container is mounted to the pivot arm and pivotable to be raised and lowered between a stored position and an accessible position. In the stored position, the storage container is disposed within the overhead storage area and the conforming wall is upright. In the accessible position, the storage container is disposed below the overhead storage area and the conforming wall provides access to the storage container interior. A residential living unit and method are also disclosed.

20 Claims, 13 Drawing Sheets

(58) Field of Classification Search

CPC . A47B 88/48; A47B 2210/0056; A47B 77/10; A47B 77/04; A47B 88/60; A47B 88/433; A47B 88/40; A47B 63/00; A47B 95/008; A47B 2088/901; A47B 88/42; A47B 49/002; B62H 3/00; B62H 3/12; B62H 3/02; A47F 5/0892; E04H 6/005; E04F 19/08

USPC ..... 312/246, 233, 322, 245, 247, 306, 201, 312/248, 266, 242, 323, 325, 334.23, 315, 312/319.2, 319.3, 351, 334.6; 211/96, 99, 211/100, 116

See application file for complete search history.

(56) References Cited

U.S. PATENT DOCUMENTS 415,056 A 11/1889 Phillips
478,566 A * 7/1892 Caspar ..... A47L 15/427 312/276
479,857 A 8/1892 Tettelbach
481,586 A 8/1892 Paul
581,803 A 5/1897 Armstrong
971,493 A * 9/1910 Crane ..... A47G 25/0685 211/99
1,095,363 A 5/1914 Weiss
1,137,074 A * 4/1915 Morris ..... A47B 88/48 312/323
1,312,385 A * 8/1919 Cahill ..... A47F 3/005 312/246
1,529,601 A 3/1925 Lyons
2,506,086 A 5/1950 Jess
2,547,597 A 4/1951 Roggero
2,555,254 A 5/1951 Stebbins
2,679,446 A * 5/1954 Weil ..... A47B 49/002 312/269
2,839,349 A * 6/1958 Culver ..... A47G 21/14 312/323
3,331,645 A * 7/1967 Vercellotti ..... A47B 49/002 211/74
3,464,749 A 9/1969 Bishop
3,490,601 A * 1/1970 Warn, Sr. ..... A47G 21/14 D7/637
3,524,692 A 8/1970 Preston
3,663,971 A 5/1972 Bonhote
3,770,133 A 11/1973 Kolker
3,814,366 A 6/1974 Staifer
3,973,812 A 8/1976 Poltorak
4,029,218 A * 6/1977 Matsuura ..... E04H 6/06 414/240
4,117,939 A 10/1978 Haddock
4,134,629 A 1/1979 Hansen
4,150,861 A * 4/1979 Dufrancatel ..... A47B 46/005 312/271
4,374,537 A 2/1983 Lindbergh
4,723,680 A * 2/1988 Carroll ..... A47B 88/60 220/478
4,725,108 A * 2/1988 Wilson ..... A47B 88/48 312/323
5,183,162 A 2/1993 Ritzenthaler
5,221,009 A 6/1993 Ritzenthaler
5,242,219 A 9/1993 Tomaka
5,249,858 A 10/1993 Nusser
5,294,006 A 3/1994 Deschino
5,383,628 A 1/1995 Harriehausen
5,474,189 A 12/1995 Peterson
5,475,949 A 12/1995 McCoy
5,499,584 A * 3/1996 Taylor ..... A47B 46/005 312/266
5,649,751 A 7/1997 Longhurst et al.
5,758,782 A 6/1998 Rupert
5,772,295 A 6/1998 Sundmark
5,857,756 A 1/1999 Fehre
5,934,615 A 8/1999 Treichler et al.
6,039,422 A * 3/2000 Butters ..... A47B 45/00 16/422
6,095,344 A 8/2000 White
6,250,728 B1 6/2001 Thorp
6,336,692 B1 1/2002 Snyder
6,367,898 B1 4/2002 Jobe
6,550,878 B2 4/2003 Nott et al.
6,733,095 B1 5/2004 Rieb
6,851,376 B2 2/2005 James
7,178,887 B2 2/2007 Steadman
7,246,865 B1 * 7/2007 Merrell, II ..... A47B 46/005 312/248
7,325,785 B2 2/2008 Krengel
7,770,986 B1 8/2010 Simaitis
8,061,789 B2 * 11/2011 Krueger ..... A47B 46/005 211/100
8,136,897 B2 3/2012 Mascari
8,157,108 B1 4/2012 Waldrop
8,210,370 B2 7/2012 Botkin
8,414,093 B2 4/2013 Moran
8,424,983 B1 4/2013 Strauss
8,443,991 B1 5/2013 Ivey, III
8,636,251 B2 1/2014 Mayer et al.
8,641,156 B2 2/2014 Chow
8,814,490 B2 8/2014 Inui
8,863,323 B2 10/2014 Knapp et al.
8,926,031 B2 1/2015 Belton
8,950,592 B1 2/2015 Greenblatt et al.
8,985,344 B2 * 3/2015 Larson ..... B62H 3/12 211/1.51
8,991,948 B2 3/2015 Marsters
9,055,813 B2 6/2015 Telthorster et al.
9,392,912 B2 7/2016 Haddad
9,414,672 B1 8/2016 Flynn
9,578,993 B2 2/2017 Stafford et al.
9,738,386 B2 8/2017 Walton et al.
9,980,564 B2 5/2018 Roberts et al.
10,000,287 B2 6/2018 Claflin et al.
10,085,552 B2 10/2018 Boguslawski
10,315,767 B2 6/2019 Claflin et al.
10,506,877 B1 * 12/2019 Edwards, II ..... A47B 61/04
10,925,391 B1 * 2/2021 Stilley ..... A47B 43/00
2002/0079792 A1 * 6/2002 Nott ..... A47B 46/005 312/248
2005/0102746 A1 5/2005 Wright et al.
2005/0173202 A1 8/2005 Shaw
2006/0066188 A1 3/2006 Crawford
2006/0108303 A1 5/2006 Rupert
2006/0192468 A1 * 8/2006 Gardner ..... A47B 77/04 312/198
2007/0294953 A1 * 12/2007 Guillen ..... A47B 83/001 52/36.1
2008/0182224 A1 7/2008 Ahearn
2009/0284110 A1 11/2009 Mascari
2010/0108627 A1 * 5/2010 Lupinacci ..... A47B 46/005 211/116
2013/0015145 A1 1/2013 Koepke
2015/0145393 A1 5/2015 Young
2016/0235194 A1 8/2016 Baranski
2018/0281956 A1 10/2018 Fischer

FOREIGN PATENT DOCUMENTS

EP 1925236 A1 5/2008
EP 1820420 B1 10/2008
JP 4895927 11/1973
JP 5754669 4/1982
JP S5754669 A 4/1982
JP 58196633 12/1983
JP 03128781 B2 5/1991
JP 0849403 2/1996
JP 08117036 11/1996
JP 2000079024 3/2000
JP 2000342353 12/2000
JP 2001029146 A 2/2001
JP 2012000261 A 1/2012

(56) References Cited

FOREIGN PATENT DOCUMENTS

| | | |
|---|---|---|
| NL | 7712702 | 5/1979 |
| WO | 0042886 | 7/2000 |
| WO | 2018137017 A1 | 8/2018 |

OTHER PUBLICATIONS

Translation of Office Action dated Jan. 28, 2021, JP2019-562447.
International Search Report and Written Opinion dated Dec. 30, 2020, International PCT Application PCT/CA2020/051320.
International Search Report and Written Opinion, PCT/CA2021/051556, dated Jan. 25, 2022.

* cited by examiner

PIVOTABLE OVERHEAD STORAGE UNIT

CROSS-REFERENCE TO RELATED APPLICATIONS

This application is a continuation-in-part of U.S. patent application Ser. No. 16/481,131, which is a national phase entry under 35 USC 371 of PCT patent application PCT/CA2017/050087 filed Jan. 27, 2017, the entire contents of both of which are incorporated by reference herein. Reference is made to PCT patent application PCT/CA2020/051320 filed Oct. 2, 2020 and to US provisional patent application entitled "PIVOTABLE OVERHEAD STORAGE UNIT" filed the same day as this application and whose application number will be provided once known, the entire contents of both of which are incorporated by reference herein.

TECHNICAL FIELD

The application relates generally to the storage of items and, more particularly, to overhead storage units.

BACKGROUND

In many jurisdictions, interior real estate is priced per unit of available floor space (e.g. $/ft$^2$). This pricing model encourages occupants to maximise the number of features that can comfortably be provided within a minimum area of floor space, resulting in a reduction of features and increased comfort.

In urban residential areas, relatively high unit floor space costs incentivize the construction of smaller living units. Developers of these smaller living units still wish to offer their occupants features and accessories associated with larger living areas, in order to accommodate the occupant's lifestyle. However, providing such features and accessories is difficult because less space is available in these smaller living units.

SUMMARY

In one aspect, there is provided an overhead storage unit, comprising: an elongated guide member having a first horizontal segment mountable within an overhead storage area, a second vertical segment mountable below the overhead storage area, and a curved segment extending between the first and second segments; and a storage container having at least a first wall, the storage container mountable to the guide member and displaceable therealong to be raised and lowered between a stored position and an accessible position, the first wall disposed at least partially within the overhead storage area and having a first orientation to define a bottom surface of the storage container in the stored position, and the first wall disposed below the overhead storage area and having a second orientation different from the first orientation in the accessible position.

In another aspect, there is provided a residential living unit, comprising: an overhead storage area; and an overhead storage unit, comprising: an elongated guide member having a first horizontal segment mounted within the storage area, a second vertical segment mounted below the storage area, and a curved segment extending between the first and second segments; and a storage container having at least a first wall, the storage container mounted to the guide member and displaceable therealong to be raised and lowered between a stored position and an accessible position, the first wall disposed within the storage area and having a first orientation to define a bottom surface of the storage container in the stored position, and the first wall disposed below the storage area and having a second orientation different from the first orientation in the accessible position.

In a further aspect, there is provided a method of storing an item in an overhead storage area, comprising: loading the item in a storage container having an orientation and being disposed beneath the overhead storage area; and raising the storage container to be stored within the overhead storage area by upwardly displacing the storage container along a pre-defined path, upward displacement of the storage container changing the orientation of the storage container to be different from the orientation when loading the storage container.

There is disclosed a residential living unit, comprising: a ceiling, a floor and walls delimiting a space, some of the space beneath the ceiling being an overhead storage area; an overhead storage unit, comprising: a pivot arm extending from a first end to a second end, the first end pivotably mounted to a fixed pivot and the pivot arm pivotable about a pivot axis defined by the pivot; and a storage container having interconnected walls defining a storage container interior, one of the interconnected walls being a conforming wall, the storage container mounted to the second end of the pivot arm and pivotable with the pivot arm to be raised and lowered between a stored position and an accessible position, in the stored position, the storage container is disposed within the overhead storage area and the conforming wall is upright; and in the accessible position, the storage container is disposed below the overhead storage area and the conforming wall provides access to the storage container interior.

There is disclosed a method of storing items in an overhead storage area, comprising: loading the items in a storage container mounted to an arm while the storage container is beneath the overhead storage area, a wall of the storage container being horizontal and providing access to an interior of the storage container; and pivoting the arm and the storage container upward and into the overhead storage area to change an orientation of the storage container, the wall of the storage container becoming upright and blocking access to the interior of the storage container.

There is disclosed an overhead storage unit, comprising: a pivot arm extending from a first end to a second end, the first end pivotably mountable to a fixed pivot and the pivot arm pivotable about a pivot axis defined by the pivot; and a storage container having interconnected walls defining a storage container interior, one of the interconnected walls being a conforming wall, the storage container mounted to the second end of the pivot arm and pivotable with the pivot arm to be raised and lowered between a stored position and an accessible position; in the stored position, the storage container is disposed within the overhead storage area and the conforming wall is upright; and in the accessible position, the storage container is disposed below the overhead storage area and the conforming wall provides access to the storage container interior.

DESCRIPTION OF THE DRAWINGS

Reference is now made to the accompanying figures in which.

DETAILED DESCRIPTION

Figure 1A:
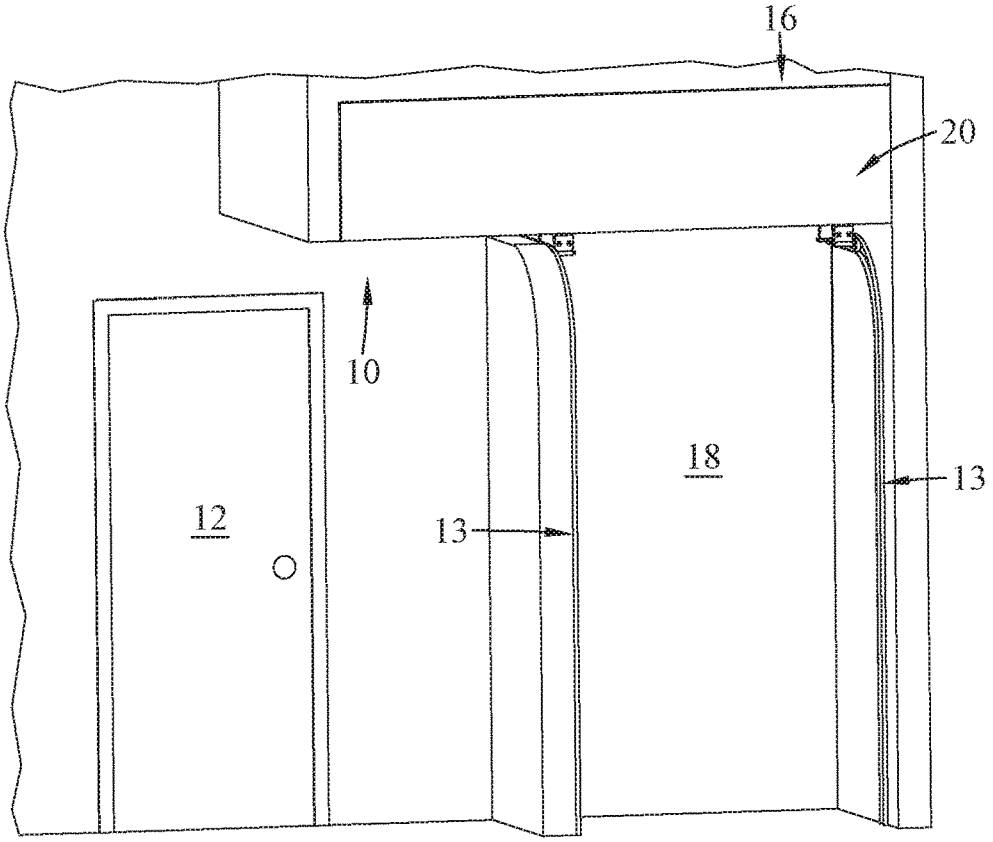
FIG. 1A is a perspective view of a residential living unit having an overhead storage unit, according to an embodiment of the present disclosure.
Figure 1B:
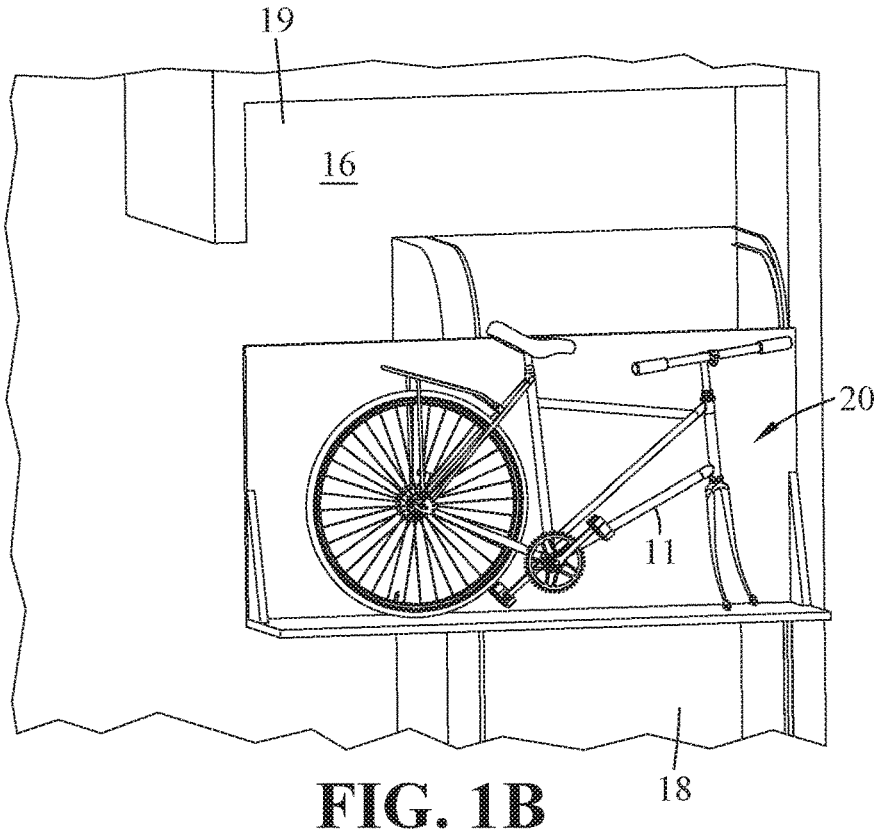
FIG. 1B is another perspective view of the overhead storage unit of FIG. 1A.

FIGS. 1A and 1B illustrate an embodiment of an overhead storage unit 10 provided in a residential living unit 12. In the depicted embodiment, the living unit 12 is a residential apartment, but it will be appreciated that the living unit 12 can also be other types of dwellings. Some non-limiting examples of a living unit 12 include a flat, condo, home, room, etc. Features of the overhead storage unit 10 (sometimes referred to herein simply as "storage unit 10") are displaceable so that one or more items 11 to be stored within the storage unit 10 can be stored away when not in use, and so that access to the items 11 can be provided. When stored away, features of the storage unit 10 are positioned such that they do not occupy the floor space of the living unit 12. This allows the valuable floor space to be liberated and used for other purposes, thereby contributing to the overall available floor space of the living unit 12. As will be described in greater detail herein, the storage unit 10 positions the items 11 in an overhead storage area 16.

The overhead storage area 16 is disposed above the floor of the living unit 12. More particularly, the overhead storage area 16 is located about the average level of the head of an occupant of the living unit 12. This position of the overhead storage unit 16 allows the occupant to move freely about the living unit 12 without being obstructed by the storage unit 10. The configuration of the overhead storage area 16 can take different forms. For example, in the depicted embodiment, the overhead storage area 16 is located above a closet 18 of the living unit 12. The overhead storage area 16 is defined by the interconnected walls of an overhead structure 19 positioned on top of the closet 18. In alternate embodiments, the overhead storage area 16 is disposed adjacent to the ceiling, in a plenum area defined within a suspended ceiling and above the living unit 12. In another alternate embodiment, the overhead storage area 16 is defined by a lowered section of the ceiling that is continuous with the remainder of the ceiling of the living unit 12. It is therefore appreciated that many configurations of the overhead storage area 16 are within the scope of the present disclosure, provided that the overhead storage area 16 is raised above the floor of the living unit 12 such that the storage unit 10, when stored within the overhead storage area 16, does not disrupt the movement of the occupant about the living unit 12. Features of the storage unit 10 are displaceable to raise the items 11 into the overhead storage area 16 to store the items 11 away, and to lower the items 11 from the overhead storage area 16 to provide access to the items 11.

Figure 2A:
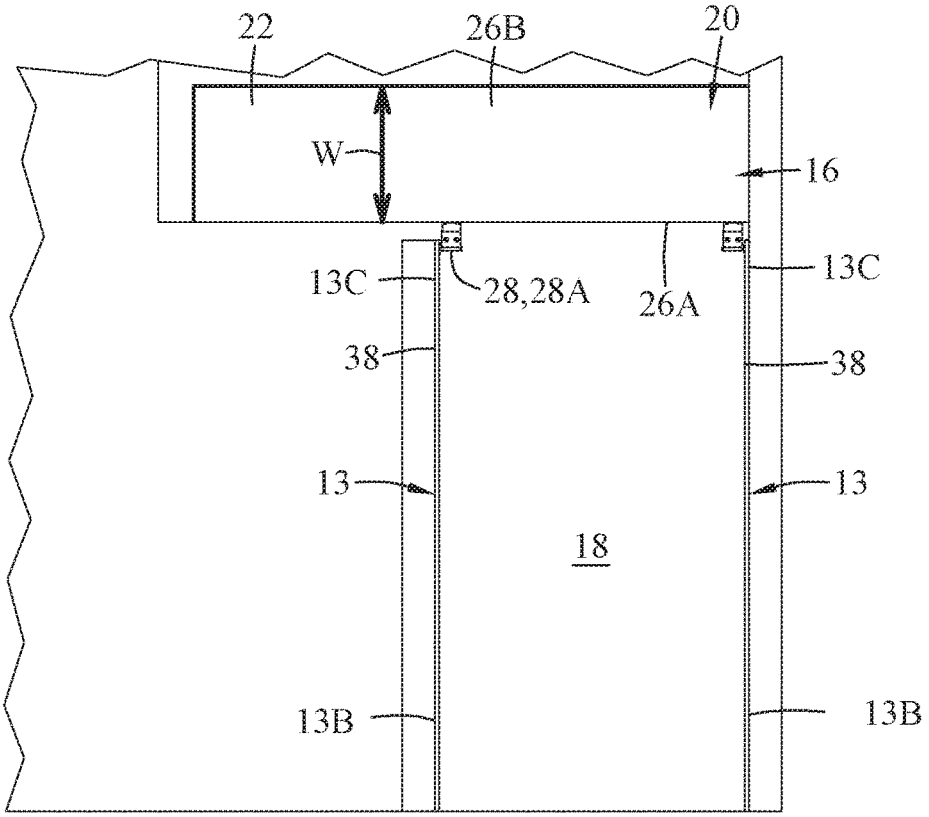
FIG. 2A is a perspective view of the overhead storage unit of FIG. 1A being shown in a stored position.
Figure 2B:
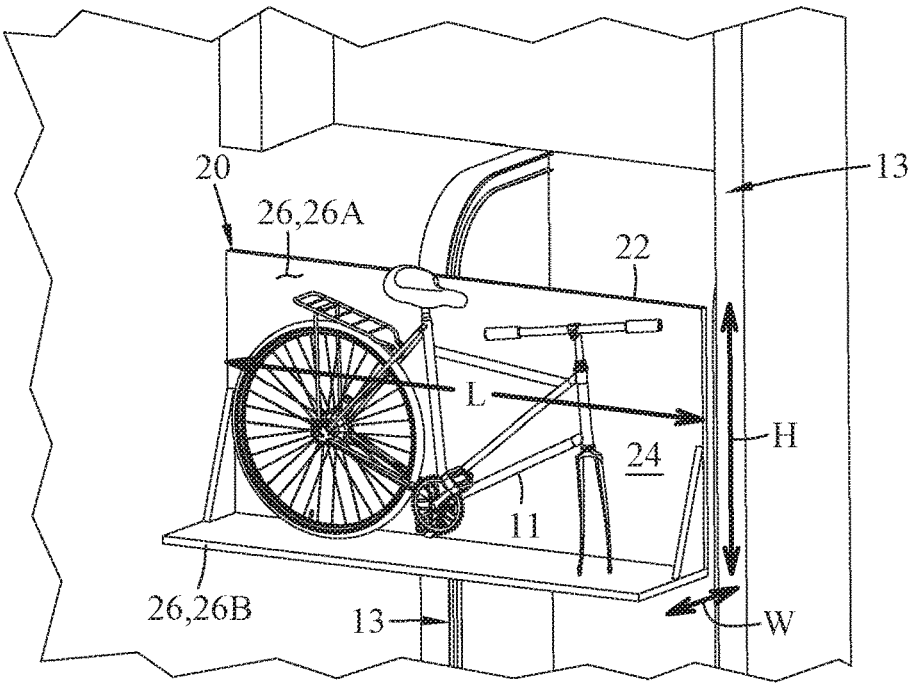
FIG. 2B is a perspective view of the overhead storage unit of FIG. 1A being shown in an accessible position.

Referring to FIGS. 2A and 2B, the storage unit 10 includes a displaceable storage container 20 for storing the items 11, and one or more guide members 13 for guiding displacement of the storage container 20 between a stored position and an accessible position.

The storage container 20 can be any suitably shaped and sized object for holding and displacing the items 11. In the depicted embodiment, the storage container 20 includes a box-like storage structure 22 having an at least partially hollow interior 24 in which the items 11 are stored. The storage structure 22 includes one or more interconnected walls 26, which include at least a first wall 26A and a second wall 26B. The walls 26 are depicted as being planar bodies, but may be non-planar in other embodiments. Similarly, the first and second walls 26A,26B are shown as being substantially uninterrupted along their length, but in alternate embodiments, one or both of the first and second walls 26A,26B may be interrupted along their length.

The first wall 26A and the second wall 26B are interconnected along their common edges and are perpendicular with respect to one another. The first wall 26A is the lowermost wall 26 of the storage structure 22 when the storage container 20 is in the stored position, as shown in FIG. 2A. The first wall 26A has a first orientation such that it defines a bottom surface 26C (see FIGS. 3A and 3B) of the storage container 20. In the depicted embodiment, the bottom surface 26C is the lowermost surface of the storage container 20 when it is in the stored position. The second wall 26B is the lowermost wall 26 of the storage structure 22 when the storage container 20 is in the accessible position, as shown in FIG. 2B. The second wall 26B can contribute to supporting the weight of the items 11 stored within the storage structure 22. The first wall 26A can also contribute to supporting the weight of the items 11 stored within the storage structure 22 when in the stored position. The storage structure 22 can include hooks, brackets, ties, mounts, or other devices to secure the items 11 therein, and to prevent their displacement during movement of the storage container 20. In an embodiment, the storage structure 22 has a door to provide access to the interior 24 and to the items 11 therein. In an alternate embodiment, the storage structure 22 is open along a front portion thereof to provide direct access to the interior 24.

In the depicted embodiment, the item 11 stored within the storage structure 22 is a bicycle. In order to store such items 11, the storage container 20 or storage structure 22 may include interconnected walls 26 which define a hermetically-sealed interior 24. The sealed interior 24 prevents liquids and debris from exiting the storage container 20 during displacement thereof. Similarly, the storage container 20 can be made from any suitable material to confer impermeability, amongst other desired properties. The storage container 20 may be used to store other types of items 11 as well The storage container 20 is mounted to the one or more guide members 13. Each guide member 13 extends along a length to guide the displacement of the storage container 20 along said length. More particularly, each guide member 13 has a first horizontal segment 13A mounted within the overhead storage area 16. In the depicted embodiment, the first segment 13A is mounted to an upper extremity of the closet 18 at a lower end of the overhead storage area 16. Each guide member 13 also has a second vertical segment 13B mounted below the overhead storage area 16. In the depicted embodiment, the second segment 13B is mounted to a lower extremity of the closet 18. The second segment 13B extends downwardly from the overhead storage area 16 to about the level of the floor. Each guide member 13 also has a curved segment 13C extending between the first and second segments 13A,13B. In the depicted embodiment, the curved segment 13C is downwardly curved to guide displacement of the storage container 20 from the raised stored position to the lowered accessible position. Each segment 13A,13B,13C defines a portion of a pre-defined displacement path along which the storage container 20 is guided when being displaced. In an alternate embodiment, the segments 13A,13B,13C are not mounted directly to a structure, but are free standing.

It will be appreciated that each guide member 13 can take any suitable form to accomplish the above-described functionality. For example, in the depicted embodiment, each guide member 13 includes a guide rail 38. FIGS. 2A and 2B show two laterally-spaced apart guide rails 38 mounted to opposed lateral sides of the closet 18. The storage container 20 has rotatable guide bodies 28, which in the depicted embodiment are guide wheels 28A, mounted to an underside of the storage container 20. Each guide wheel 28A engages a corresponding one of the guide rails 38 to be displaced along the guide rail 38. The cooperation of the guide wheels 28A with the guide rails 38 allows the storage container 20 to be displaced.

Other configurations for the guide member 13 are within the scope of the present disclosure. In an alternate embodiment, each guide member 13 includes an elongated rack and the storage container 20 has a rotatable guide body that includes a gear, such as a pinion. Each guide body pinion engages a corresponding one of the racks to be displaced therealong. In another alternate embodiment, each guide member 13 includes a groove in a surface of the closet 18, for example, and the storage container 20 has a rotatable guide body that includes a wheel. Each guide body wheel engages a corresponding one of the grooves to be displaced therealong.

The displacement of the storage container 20 along the guide member 13 changes the orientation of the storage container 20. The storage container 20 is displaceable to be raised to a stored position, and lowered to an accessible position.

In the stored position, and as shown in FIG. 2A, the storage container 20 and the items 11 are stored away. The storage container 20 and/or the first wall 26A have a first orientation. In the depicted embodiment, the first wall 26A and the storage container 20 lie horizontally within the overhead storage area 16 in the stored position. The storage container 20 and the items 11 are therefore raised above the floor of the living unit 12 to be stored away, thereby freeing up the floor space of the living unit 12. In the depicted embodiment, the storage container 20 is on its "back", such that the first wall 26A of the storage structure 22 has a horizontal orientation and the second wall 26B has an upright orientation. The storage structure 22 is shown resting on, and supported by, the first horizontal segment 13A of the guide members 13. In the depicted embodiment, the overhead storage area 16 is concealed from view by the storage container 20 when it is in the stored position. In an alternate embodiment, a part of the storage container 20 protrudes out of the overhead storage area 16 when the storage container is in the stored position. In such an embodiment, the storage container 20 is disposed at least partially within the overhead storage area 16.

In the accessible position, and as shown in FIG. 2B, the storage container 20 and the items 11 are accessible to the occupant. The storage container 20 and/or the first wall 26B have a second orientation that is different from the first orientation shown in FIG. 2A. In the depicted embodiment, the second orientation is offset from the first orientation by about 90°. The first wall 26A and the storage container 20 are disposed upright below the overhead storage area 16 so that the occupant can access the items 11 in the storage container 20. The storage container 20 and the items 11 are therefore suspended in proximity to the floor of the living unit 12. In the depicted embodiment, the first wall 26A of the storage structure 22 has an upright orientation and the second wall 26B has a horizontal orientation. The storage structure 22 is engaged with the second vertical segment 13B of the guide members 13.

It is thus appreciated that the first wall 26A, and indeed other walls 26 of the storage structure 22, under a change in orientation when the storage container 20 is displaced between the stored and accessible positions. This change in the orientation of the storage container 20 may be better appreciated by considering the dimensions of the storage structure 22 as it is displaced between the stored and accessible positions. The storage structure 22 has a height H, a length L, and a width W. In the stored position, the width W of the storage structure 22 is measured in a vertical plane and the height H is measured in a horizontal plane. In the accessible position, the width W of the storage structure 22 is measured in a horizontal plane and the height H is measured in a vertical plane.

This change in the orientation of the storage container 20 between the stored and accessible positions allows the storage container 20 to occupy a minimum volume of the overhead storage area 16 without compromising the interior 24 storage space for the items 11. More particularly, the storage container 20 in the stored position has a substantially flat or horizontal profile, such that it occupies less vertical space than when it is has an upright orientation. This allows for a smaller overhead storage area 16 to be used, which may be particularly desirable in living units 12 which have low ceilings. Similarly, the upright orientation of the storage container 20 in the accessible position allows full access to the interior 24 by the occupant, at a lowered position that is comfortable for the occupant to load and unload the items 11 from the storage container 20.

Figure 3A:
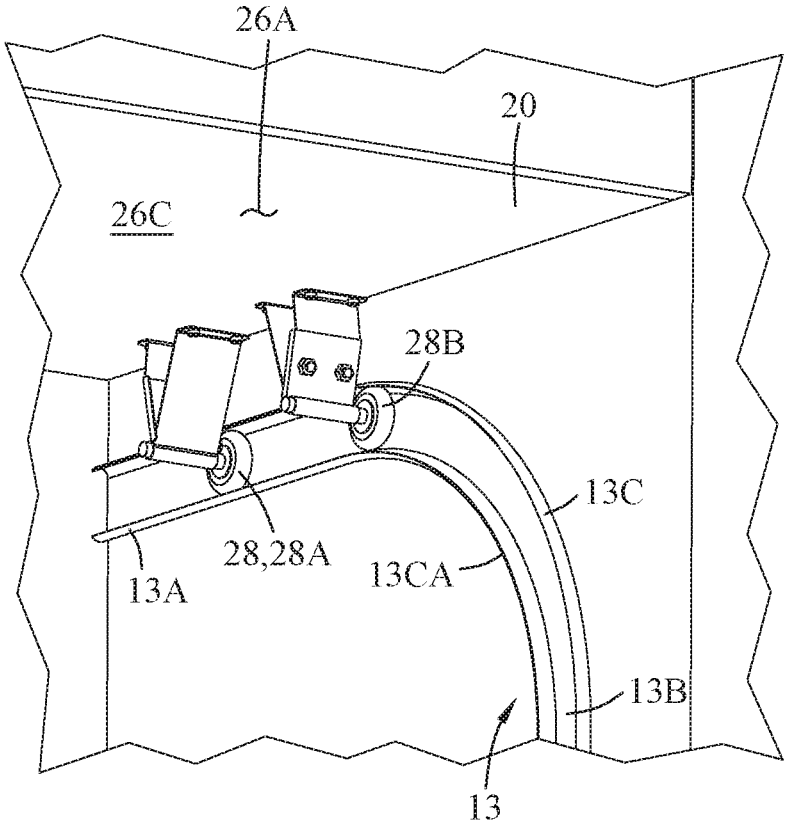
FIG. 3A is a perspective view of a guide member of the overhead storage unit of FIG. 1A.
Figure 3B:
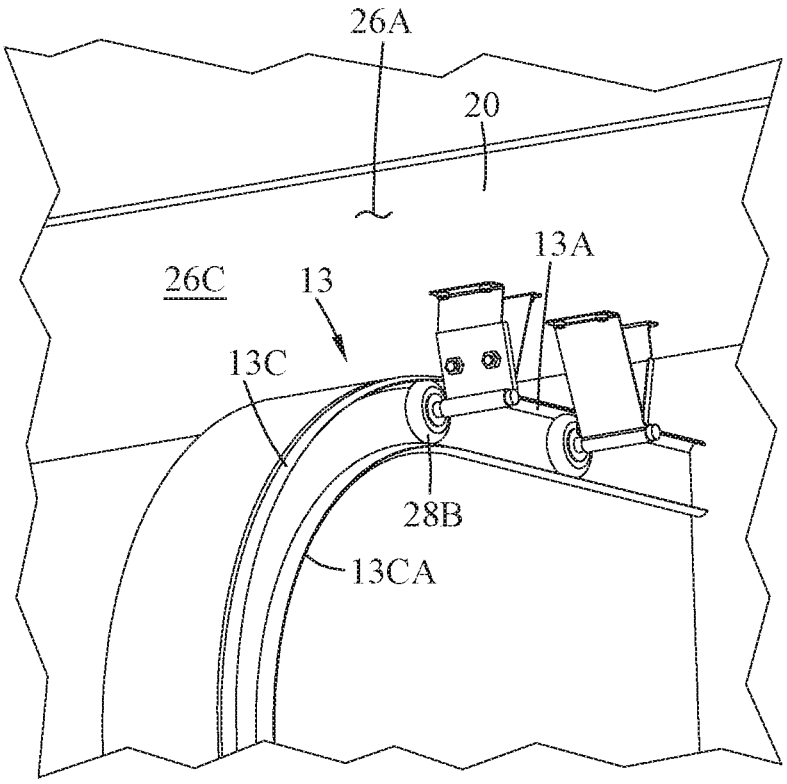
FIG. 3B is another perspective view of the guide member of FIG. 3A.

Referring to FIGS. 3A and 3B, the curved segment 13C of each guide member 13 helps to change the orientation of at least the first wall 26A. The curved segment 13C extends between the horizontal first segment 13A and the vertical second segment 13B. From the stored position in which the first wall 26A has the first orientation, it and the storage container 20 are first displaced along the first segment 13A in a horizontal plane and then downwardly over the curved segment 13C. The curved segment 13C changes the orientation of the first wall 26A to the second orientation as it is being displaced such that the first wall 26A is upright after having been displaced past the curved segment 13C and along the vertical second segment 13B. The second orientation of the first wall 26A is therefore offset from the first orientation by about 90°.

In the depicted embodiment, the rotatable guide bodies 28 of the storage container 20 include leading guide bodies 28B displaceable along corresponding guide members 13. The leading guide bodies 28B, shown in the depicted embodiment as leading guide wheels, engage two laterally-spaced apart guide members 13 so as to form a pair of leading guide bodies 28B. The leading guide bodies 28B are disposed adjacent to an upper end of the curved segment 13C of each guide member 13 when the storage container 20 is in the stored position. By positioning the leading guide bodies 28B in proximity to the upper end of the curved segment 13C, the effort required to lower the storage container 20 from the stored position is reduced. Indeed, the close proximity of the leading guide bodies 28B to the upper end of the curved segment 13C means that the storage container 20 only has to travel a relatively short distance along the first segment 13A before the leading guide bodies 28B enter the curved segment 13C, at which point gravity acting on the storage container 20 will assist in lowering it from the stored position. This reduced effort is particularly useful if the storage container 20 is manually displaced, as discussed in greater detail below.

The proximity of the leading guide bodies 28B to the upper end of the downwardly curved segment 13C can vary, depending on the desired effort required to lower the storage container 20, amongst other factors. For example, in the depicted embodiment, the leading guide bodies 28B have a default location within a downwardly curved portion 13CA of the curved segment 13C when the storage container 20 is in the stored position. This positioning of the leading guide bodies 28B helps to bias the storage container 20 downward, and thus helps to reduce the effort required to lower the storage container 20. In such a configuration, tension may be applied to the storage container 20 to hold it back and reduce the likelihood of it accidentally lowering. This tension can be provided by a cable, spring, or other mechanical device.

In an alternate embodiment, the leading guide bodies 28B are disposed at the onset of the downwardly curved portion 13CA of the curved segment 13C when the storage container 20 is in the stored position. This positioning of the leading guide bodies 28B also helps to bias the storage container 20 downward, and thus helps to reduce the effort required to lower the storage container 20. In another alternate embodiment, the leading guide bodies 28B are disposed on the first segment 13A just before the junction of the first segment 13A and the curved segment 13C. This positioning of the leading guide bodies 28B still facilitates lowering the storage container, but more effort may be required than in the configuration where the leading guide bodies 28B are within the downwardly curved portion 13CA. Although the curved segment 13C is shown in FIGS. 3A and 3B as having two downwardly curved portions 13CA, in an alternate embodiment, the curved segment 13C has only one downwardly curved portion 13CA along which the leading guide bodies 28B are displaced.

Figure 4:
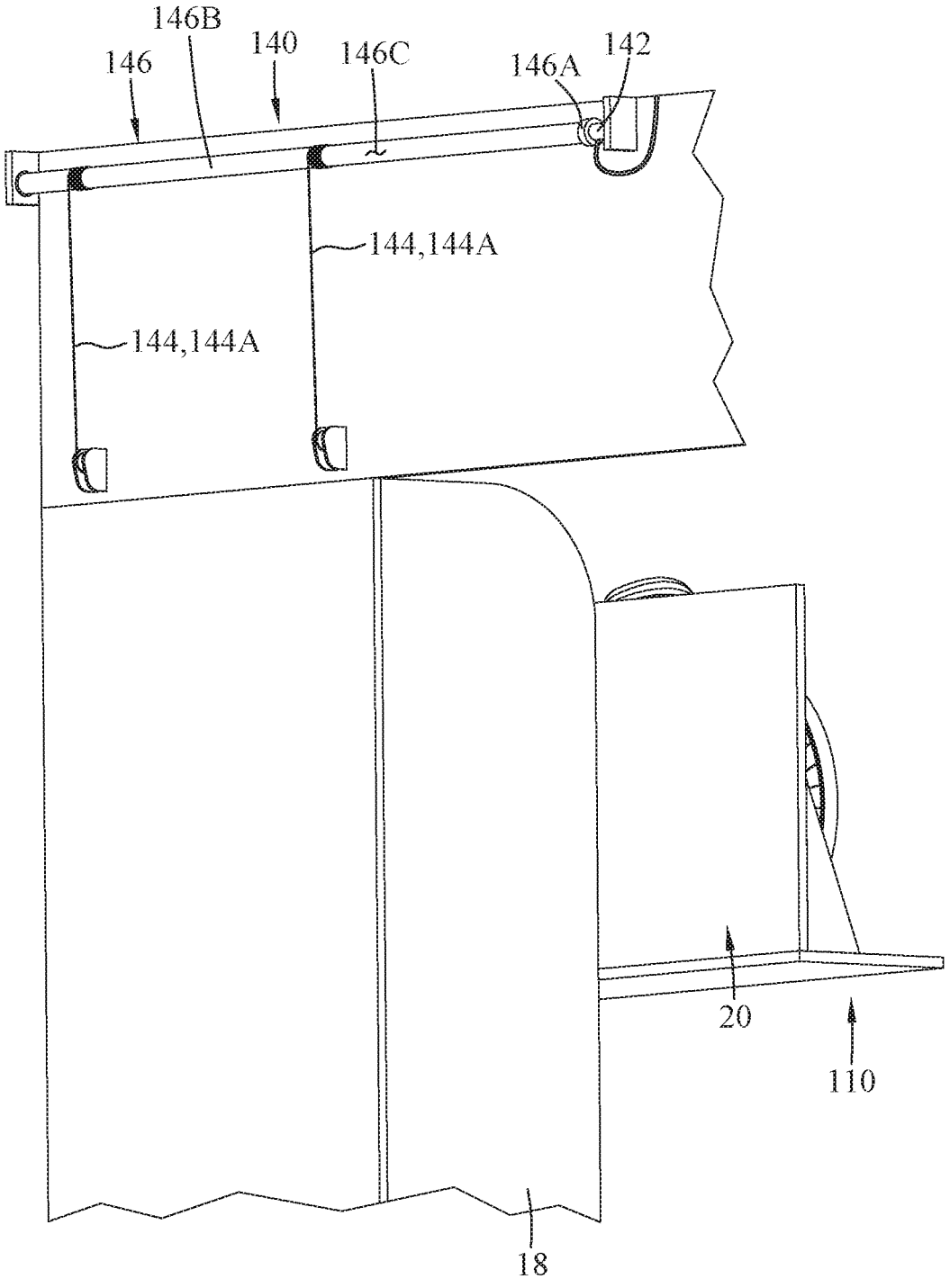
FIG. 4 is a perspective view of a motor assembly of an overhead storage unit.

The displacement of the storage container 20 along the guide member 13 can be performed manually by the occupant, or with the assistance of motive power. In the embodiment of FIG. 4, the storage unit 10 includes a motive power source. More particularly, the storage unit 10 has a motor assembly 140. The motor assembly 140 provides motive power to the storage container 20 to displace it between the stored and accessible positions. In the depicted embodiment, and to optimise available space, the motor assembly 140 is mounted behind the closet 18. In an alternate embodiment, and to improve access thereto, the motor assembly 140 is mounted above the closet in the overhead storage area 16. The motor assembly 140 includes a motor 142. Suitable brackets or mountings can be provided to secure the motor 142 in place. The motor 142 drivingly engages one or more displacement members 144. The displacement members 144 are mounted to the storage container 20 to displace it between the stored and accessible positions. The motor 142 can be controlled manually with a switch, or from a distance with a remote in communication with the motor 142 to control actuation thereof.

In the embodiment of FIG. 4, the motor 142 includes a tubular motor 146 and the displacement members 144 include motor cables 144A. The tubular motor 146 has a motive output 146A that rotationally drives a motor housing 146B or sleeve having an outer surface 146C. The outer surface 146C of the motor housing 146B is rotatable about a longitudinal axis of the tubular motor 146. The motor cables 144A are wound about the outer surface 146C, such that rotation of the motor housing 146B causes the motor cables 144A to spool and unspool about the outer surface 146C. An end of each motor cable 144A is attached to the storage container 20 so that the spooling and unspooling of the motor cables 144A will cause the storage container 20 to displace.

The displacement of the storage container 20 with the motor assembly 140 occurs as follows. To lower the storage container 20 from the stored position where it has the first orientation, the tubular motor 146 performs a controlled unspool of the motor cables 144A by rotating to unwind the motor cables 144. This provides slack in the motor cables 144A allowing the storage container 20 to descend based on gravity. To raise the storage container 20 from the accessible position, the tubular motor 146 draws in the motor cables 144A by rotating to spool them about the outer surface 146C. This removes slack from the motor cables 144A and applies tension thereto, causing the storage container 20 to be raised along the guide member 13.

Other techniques are within the scope of the present disclosure for displacing the storage container 20. In an alternate embodiment, the motive power is supplied by any other suitable type of drive, including, but not limited to, a crank with a manual mechanism and/or a spring balance. In an embodiment, the storage unit 10 includes a sensor to monitor displacement of the storage container 20, and to prevent the storage container 20 from being lowered too far. Similarly, the storage unit 10 may include a stop member to limit the downward displacement of the storage container 20.

Referring to FIGS. 2A and 2B, there is also disclosed a method of storing an item 11 in an overhead storage area 16. The item 11 is loaded in the storage container 20 which has a first orientation, and which is disposed beneath the overhead storage area 16. The storage container 20 is raised to be stored partially or completely within the overhead storage area 16. The storage container 20 is raised by upwardly displacing it, such as with the assistance of motive power, along a pre-defined path, such as the one provided by the guide member 13. The upward displacement of the storage container 20 changes its orientation to be different from the orientation when loading the storage container 20.

Other embodiments of the overhead storage unit 10 and of the residential living unit 12 are within the scope of the present disclosure. Some of these are described now in greater detail.

Figure 5A:
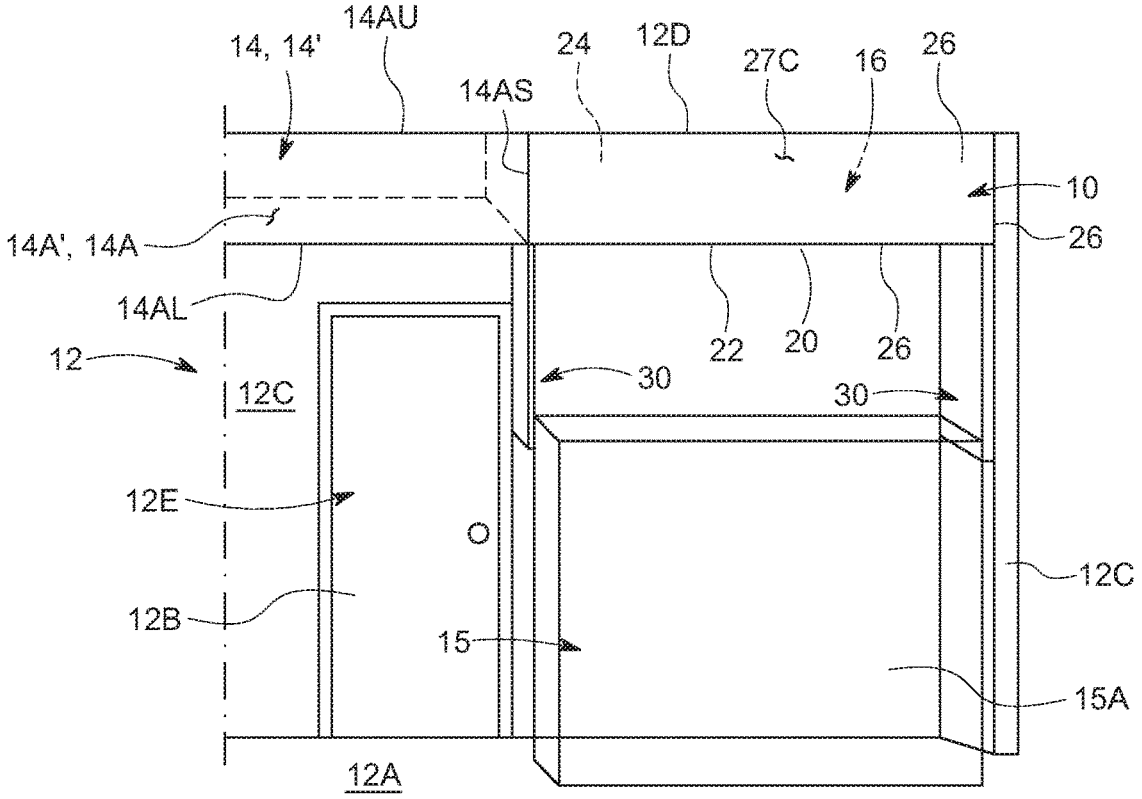
FIG. 5A is a perspective view of another residential living unit having another overhead storage unit.
Figure 5B:
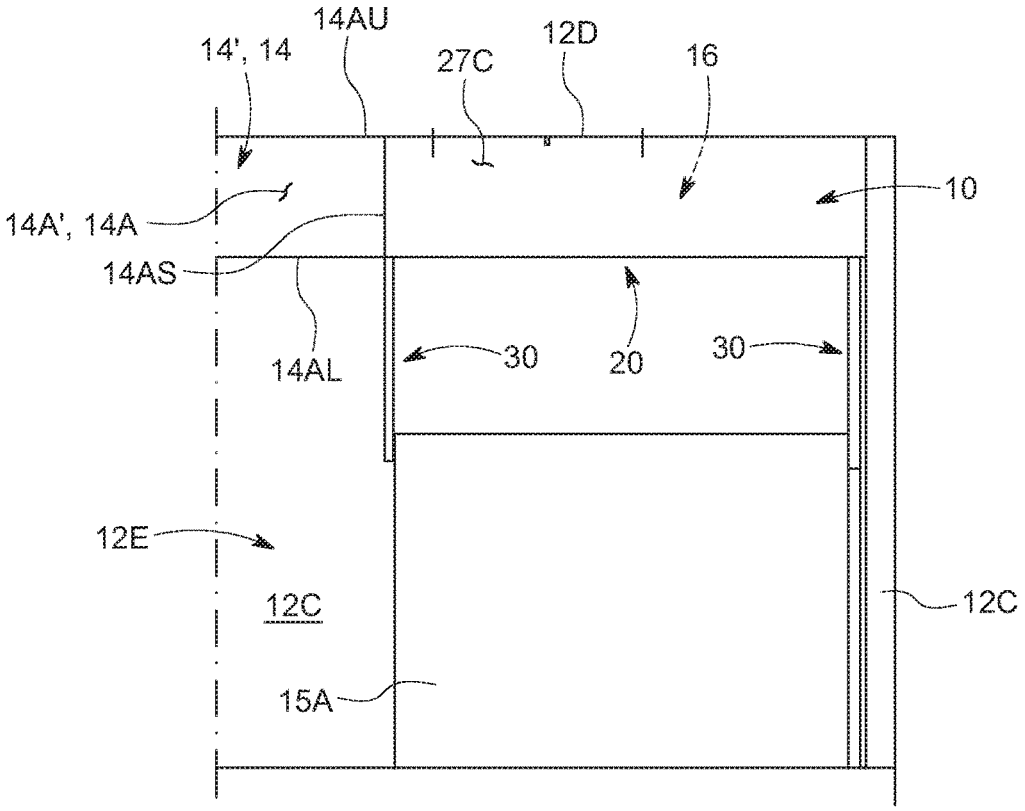
FIG. 5B is another perspective view of the overhead storage unit of FIG. 5A being shown in a stored position.

FIGS. 5A and 5B illustrate another embodiment of the overhead storage unit 10 provided in the residential living unit 12. In the depicted embodiment, the residential living unit 12 is a residential apartment. In the depicted embodiment, the living unit 12 is a room of a residential apartment. The residential living unit 12 has a floor 12A defining a floor space or area of the living unit 12 and a door 12B providing access to the residential living unit 12. The residential living unit 12 also has multiple upright walls 12C, and a ceiling 12D defining an upper bound of the residential living unit 12. The ceiling 12D, the floor 12A and the walls 12C delimit an interior space 12E which is used or occupied by the occupant of the residential living unit 12, or by the occupant's possessions. The residential living unit 12 may include other features. The residential living unit 12 can also be other types of dwellings. Some non-limiting examples of a residential living unit 12 may be, or may include, a flat, condo, home, room, etc. The residential living unit 12 can also be other types of enclosed spaces that are not solely residential, or that are only commercial. Some non-limiting additional examples of other types of living units 12 may be a garage, a show room, a conference room, etc. Thus the living unit 12 may be any enclosed space which is designed for people to live in, or which is commercial in nature.

Features of the storage unit are displaceable so that one or more items 11 (see FIG. 6B) to be stored within the storage unit 10 can be stored away when not in use, and so that access to the items 11 can be provided. When stored away, features of the storage unit 10 are positioned such that they do not occupy the floor space defined by the floor 12A of the residential living unit 12. This allows the valuable floor space to be liberated and used for other purposes, thereby increasing the overall usable and livable floor space of the residential living unit 12. As will be described in greater detail herein, the storage unit 10 positions the items 11 in an overhead storage area 16 (see FIG. 6B as well).

Referring to FIGS. 5A and 5B, the space 12E of the residential living unit 12 includes one or more overhead structures 14. The overhead structure 14 is an object or assembly that is positioned in the upper reaches of the space 12E, and that may be accessed or touched only by reaching up from the floor 12A. The overhead structure 14 is above the level of the head of the occupant when standing on the floor 12A. The overhead structure 14 in FIGS. 5A and 5B is fixed in position. The overhead structure 14 in FIGS. 5A and 5B is immobile. The position of the overhead structure 14 in FIGS. 5A and 5B does not move relative to the walls 12C, ceiling 12D and floor 12A of the residential living unit 12. The overhead structure 14 is positioned in proximity to the ceiling 12D in FIGS. 5A and 5B. The expression "in proximity" describes different arrangements of the nearness of the overhead structure 14 to the ceiling 12D. In one possible arrangement, the overhead structure 14 is directly attached or mounted to the ceiling 12D, as shown in FIGS. 5A and 5B. In another possible arrangement, the overhead structure 14 is positioned against one of the walls 12C and immediately underneath the ceiling 12D but spaced apart therefrom. In yet another possible arrangement, the overhead structure 14 is part of the ceiling 12D, such as in arrangements where the overhead structure 14 is a bulkhead of the ceiling 12D, a suspended part of the ceiling 12D, or defines a lower level of the ceiling 12D. Other arrangements are also possible. In all possible arrangements of the nearness of the overhead structure 14 to the ceiling 12D, the overhead structure 14 has an upright visible wall 14A. The upright visible wall 14A is a portion or component of the overhead structure 14 that is visible and observable to the occupant of the residential living unit 12 when the occupant is within the space 12E. The upright visible wall 14A has a lower edge 14AL, an upper edge 14AU, and one or more side edges 14AS.

Figure 10A:
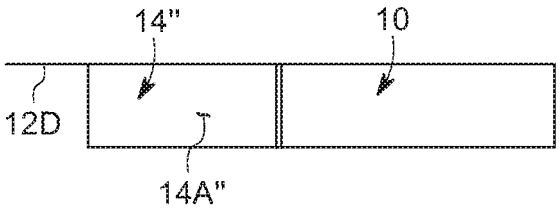
FIG. 10A is a schematic view of an overhead structure adjacent to the overhead storage unit of FIG. 5A.
Figure 10B:
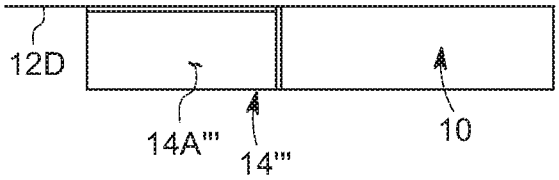
FIG. 10B is a schematic view of another overhead structure adjacent to the overhead storage unit of FIG. 5A.

A non-exhaustive list of examples of possible overhead structures 14 are now provided. Referring to FIGS. 5A and 5B, the overhead structure 14 is a box-like structure or cuboid. For example, in FIGS. 5A and 5B, the overhead structure 14 is a cabinet 14' mounted just underneath the ceiling 12D. The upright visible wall 14A' is a door or drawer of the cabinet 14'. In FIG. 10A, the overhead structure 14 is a bulkhead 14" of the ceiling 12D which is positioned lower than the plane defined by the remainder of the ceiling 12D. The bulkhead 14" defines a cavity for lighting, wiring, or piping. The upright visible wall 14A" is one or more of the visible vertical walls of the bulkhead 14". In FIG. 10B, the overhead structure 14 is a suspended part 14''' of the ceiling 12D which is positioned lower than the plane defined by the remainder of the ceiling 12D. The upright visible wall 14A''' is a vertical wall linking the suspended part 14''' of the ceiling 12D to the remainder of the ceiling 12D. In yet another example, the overhead structure 14 is a ventilation duct mounted just underneath the ceiling 12D. The upright visible wall 14A in such a configuration of the overhead structure 14 is a vertical wall of the ventilation duct.

Referring to FIGS. 5A and 5B, irrespective of its form or shape, the overhead structure 14 partially delimits the overhead storage area 16. The overhead storage area 16 is disposed above the floor 12A of the residential living unit 12, and is part of the interior volume or space 12E. The overhead storage area 16 is separate from the overhead structure 14. In FIGS. 5A and 5B, the overhead storage area 16 is not nested within, or part of, the overhead structure 14. Rather, the overhead storage area 16 is adjacent to the overhead structure 14 and beneath the ceiling 12D. In FIGS. 5A and 5B, the overhead storage area 16 has the same height, measured from the floor 12A, as the overhead structure 14. In FIGS. 5A and 5B, the overhead storage area 16 has an uppermost boundary at the ceiling 12A, and extends downwardly therefrom toward the floor 12A until a lowermost boundary which is above the average level of the head of an occupant of the residential living unit 12. This position of the overhead storage area 16 allows the occupant to move freely about the residential living unit 12 without being obstructed by the overhead storage unit 10. On one or more of its left or right boundaries, the overhead storage area 16 is delimited by one of the side edges 14AS of the upright visible wall 14A, and may also be delimited by an upright side wall of the overhead structure 14 if it has one. One of the upright walls 12C of the residential living unit 12 delimits and defines a rear or back boundary of the overhead storage area 16. The overhead storage area 16 is open along its front or forward side to receive the overhead storage unit 10.

The shape and extent of the overhead storage area 16 may take different forms. For example, in FIGS. 5A and 5B, the overhead storage area 16 is located in the upper reaches of the residential living unit 12 and is inaccessible to the occupant without a ladder. The overhead storage area 16 is a box-like or cuboid volume that is bounded by two of the walls 12C of the residential living unit 12 and by the cabinet 14'. The volume of the overhead storage area 16 is separate and set apart from the interior volume defined by the overhead structure 14 (i.e. the cabinet 14' in FIGS. 5A and 5B). It is therefore appreciated that many configurations of the overhead storage area 16 are within the scope of the present disclosure, provided that the overhead storage area 16 is raised above the floor 12A of the residential living unit 12 such that the storage unit 10, when positioned within the overhead storage area 16, does not disrupt the movement of the occupant about the residential living unit 12. For example, another possible configuration of the overhead storage area 16 is shown in FIGS. 11A-11D. The overhead storage area 16 extends between opposed walls 12C of the residential living unit 12. In FIGS. 11A-11D, the overhead storage area 16 has an uppermost boundary at the ceiling 12A, and extends downwardly therefrom toward the floor 12A until a lowermost boundary which is above the average level of the head of an occupant of the residential living unit 12, and is bounded on its sides by the walls 12C. Features of the storage unit 10 are displaceable to raise the items 11 into the overhead storage area 16 to store the items 11 away, and to lower the items 11 from the overhead storage area 16 to provide access to the items 11.

The residential living unit 12 may also have a lower structure 15. The lower structure 15 is any object or assembly within the interior space 12E of the residential living unit 12 between the walls 12C, the ceiling 12D and the floor 12A, that is also disposed below the overhead storage area 16. The lower structure 15 may thus define a lowermost boundary of the overhead storage area 16 (see FIGS. 12A-12D). Referring to FIGS. 5A and 5B, the lower structure 15 is positioned closer to the floor 12A than the overhead structure 14. The lower structure 15 may be any three-dimensional object or assembly that is separate from the overhead structure 14 and which has a separate function than the overhead structure 14. The lower structure 15 defines a volume calculated from a depth measured from the nearest wall 12C against which it rests, a height measured from the floor 12A, and a width. The lower structure 15 may thus be a piece of displaceable furniture such as a table, a drawer, or a couch. The lower structure 15 may also be a wall-mounted or other immobile structure such as a cabinet, or island in a kitchen. One possible example of the lower structure 15 is shown in FIGS. 5A and 5B. The lower structure 15 is a Murphy bed 15A. The Murphy bed 15A is shown in its retracted and upright position underneath the overhead storage area 16, and closer to the floor 12A than the overhead structure 14. Other examples of the lower structure 15 are described below. As will be explained in greater detail below, parts of the storage unit 10 move relative to the lower structure 15.

Referring to FIGS. 5A and 5B, the storage unit 10 includes one or more storage containers 20 for storing the items 11, and one or more pivot arms 30 for raising and lowering the storage containers 20 between a stored position and an accessible position.

The storage container 20 is any suitably shaped and sized object for holding and displacing the items 11. In the depicted embodiment, the storage container 20 includes a box-like storage body or structure 22 having an at least partially hollow storage container interior 24 in which the items 11 are stored. The storage structure 22 includes two or more interconnected walls 26. The walls 26 are depicted as being planar bodies that are perpendicularly mounted to one another, but may be non-planar in other embodiments. Similarly, the interconnected walls 26 are shown as being substantially uninterrupted along their length, but in alternate embodiments, one or more of the interconnected walls 26 may be interrupted along their length. Thus the storage container 20 is a volume bounded on three or more sides to define an open or closed enclosure for receiving and storing the items 11. FIGS. 5A and 5B show only one storage container 20. In alternate embodiments, the storage container 20 may be composed of multiple sub containers which are connected together.

Figure 6A:
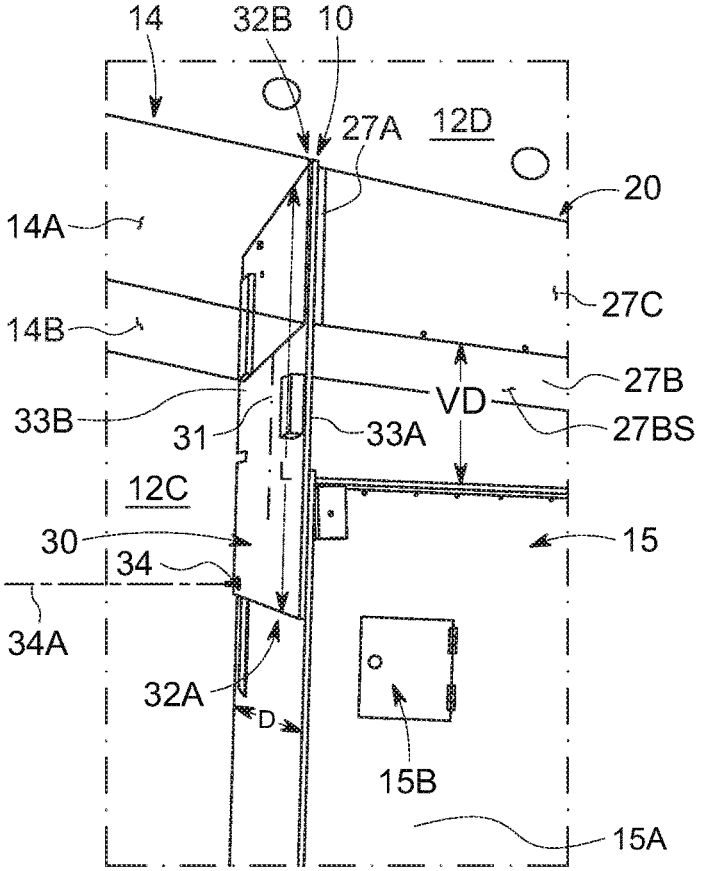
FIG. 6A is another perspective view of the overhead storage unit of FIG. 5A in the stored position.
Figure 6B:
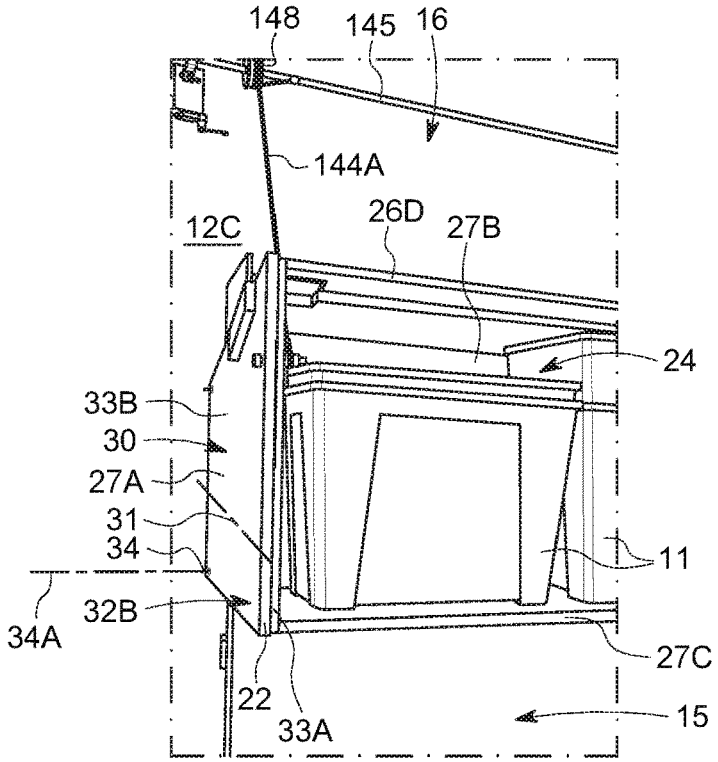
FIG. 6B is a perspective view of the overhead storage unit of FIG. 5A in an accessible position.

Referring to FIGS. 6A and 6B, the storage container 20 has five interconnected walls 26 to define the storage container interior 24, and is open along a front portion thereof to receive the items 11. The interconnected walls 26 include two side walls 27A, a back wall 27B, a conforming wall 27C, and a boundary wall 26D spaced apart from the conforming wall 27C across the storage container interior 24. The interconnected walls are interconnected along their common edges to define the box-like or cuboid structure of the storage container 20, and are perpendicular with respect to one another. Suitable structures may be provided to reinforce the interconnected walls 26. For example, one or more of the interconnected walls 26 may have frame members, brackets, or braces joining one or more of, or extending between, the interconnected walls 26.

The conforming wall 27C is a panel or other planar body with a width and height. It has at least the following two functions. First, when the storage container 20 is in the stored position, the conforming wall 27C is visible and observable to the occupant of the residential living unit 12 when the occupant is within the space 12E. In some embodiments, such as is shown in FIGS. 5A and 5B, the conforming wall 27C is the only interconnected wall 26 of the storage container 20 that is visible to the occupant in the residential living unit 12 when the storage container 20 is in the stored position. Being one of the few, or the only, interconnected wall 26 that is visible in the stored position, the conforming wall 27C operates to conceal, match, harmonize, camouflage, or blend the storage container 20 with the adjacent overhead structure 14. The conforming wall 27C thus helps the storage container 20 to appear part of, or contiguous with, the adjacent overhead structure 14. The at least one other function performed by the conforming wall 27C is that it conceals or hides the items 11 in the storage container 20 when it is in the stored position. In the stored position, the conforming wall 27C thus prevents or obstructs the occupant from viewing or observing the items 11 in the storage container interior 24 when the occupant is within the space 12E. In FIGS. 6A and 6B, the conforming wall 27C is opaque.

Figure 7:
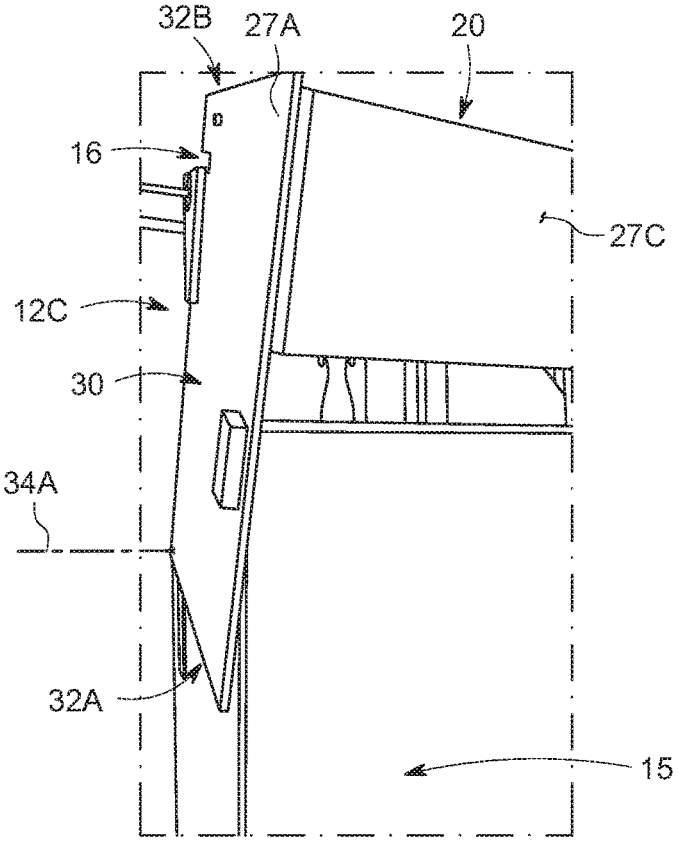
FIG. 7 is a perspective view of the overhead storage unit of FIG. 5A, showing the storage container transitioning between the stored position and the accessible position.

Referring to FIGS. 6A to 7, the interconnected walls 26 undergo a change in orientation when the storage container 20 is raised and lowered between the stored and accessible positions. The change in orientation results from a rotation or pivot of about 90°. The back wall 27B is the lowermost wall 26 of the storage structure 22 when the storage container 20 is in the stored position shown in FIG. 6A. The back wall 27B has a first orientation such that it defines a bottom surface 27BS of the storage container 20. In the depicted embodiment, the bottom surface 27BS is the lowermost surface of the storage container 20 when it is in the stored position. The conforming wall 27C is the lowermost wall 26 of the storage structure 22 when the storage container 20 is in the accessible position, as shown in FIG. 6B. The conforming wall 27C is upright and the furthest spaced of the interconnected walls 26 from the adjacent wall 12C partially delimiting the overhead storage area 16 when the storage container 20 is in the stored position, as shown in FIG. 6A. The back wall 27B contributes to supporting the weight of the items 11 stored within the storage container 20 when in the stored position. The conforming wall 27C contributes to supporting the weight of the items 11 stored within the storage container 20 when in the accessible position. The storage container 20 may include hooks, brackets, ties, mounts, or other devices in the storage container interior 24 to secure the items 11 therein, and to prevent their displacement during movement of the storage container 20. In FIGS. 6A, 6B and 4C, the storage container 20 is open along all of its front portion in the accessible position to provide unobstructed and unfettered access to all of the storage container interior 24. In FIGS. 6A, 6B and 8C, the front portion of the storage container 20 is an opening that is unobstructed by any structure, such as a door or panel. In an alternate embodiment, the storage container 20 has a door to selectively close the opening defining the front portion, to thereby selectively provide access to the storage container interior 24 and to the items 11 therein.

The other interconnected walls 26 of the storage container 20 undergo a change in orientation when the storage container 20 is raised and lowered between the stored and accessible positions. Referring to FIGS. 6A and 6B, the side walls 27A are rectangular planar bodies extending along a longitudinal axis. The longitudinal axis of the side walls 27A has an upright orientation in the stored position (see FIG. 6A), and the longitudinal axis has a substantially horizontal orientation in the accessible position (see FIG. 6B). The back wall 27B has an upright orientation in the accessible position (see FIG. 6B), and has a substantially horizontal orientation in the stored position (see FIG. 6A). The boundary wall 26D has an upright orientation in the stored position (see FIG. 6A), and has a substantially horizontal orientation in the accessible position (see FIG. 6B).

The interconnected walls 26 of the storage container 20 may be interconnected so as to define a hermetically-sealed storage container interior 24. The sealed storage container interior 24 prevents liquids and debris from exiting the storage container 20 via one of the interconnected walls 26 during displacement thereof and when the storage container 20 is stationary. Similarly, the storage container 20 may be made from any suitable material to confer impermeability, amongst other desired properties. The storage container 20 may be used to store any type of item 11. In FIGS. 6A and 6B, the storage container 20 and the overhead storage area 16 extend over only some of the distance separating two opposed walls 12C of the residential living unit 12. In an alternate embodiment, the storage container 20 and the overhead storage area 16 extend over all or substantially all of the distance separating two opposed walls 12C, as described in greater detail below.

Referring to FIGS. 6A and 6B, the one or more pivot arms 30 are mounted to the storage container 20 to raise and lower the storage container 20 by pivoting it between the stored and accessible positions. In the depicted embodiment, the storage unit 10 has two pivot arms 30. Each pivot arm 30 is mounted to, forms part of, or defines, one of the side walls 27A of the storage container 20. In FIGS. 6A and 6B, the pivot arm 30 is a single rectangular planar body extending along an elongated arm axis 31 between a first end 32A and a second end 32B. The second end 32B defines a distal extremity of each pivot arm 30. Each pivot arm 30 defines an inner surface 33A facing toward the other pivot arm 30 and toward the storage container 20, and an outer surface 33B opposite to the inner surface 33A. The body of each pivot arm 30 near the second end 32B in FIGS. 6A and 6B is or defines a side wall 27A of the storage container 20, and thus partially delimits the storage container interior 24 along the sides of the storage container 20. The inner surface 33A delimits part of the storage container interior 24. In FIGS. 6A and 6B, the interconnected walls 26 of the storage container 20 are connected or mounted to the pivot arms 30 to define the storage container interior 24. The orientation of each pivot arm 30 changes as it pivots between the stored and accessible positions. The arm axis 31 has an upright orientation in the stored position (see FIG. 6A), and the arm axis 31 has a substantially horizontal orientation in the accessible position (see FIG. 6B). Other embodiments and configurations for the pivot arm 30 are possible and within the scope of the present disclosure. In an alternate embodiment, the pivot arm 30 is one of a rod, beam, stick, pole, shaft or interconnected linkage made up of multiple members. In an alternate embodiment, the storage unit 10 has only one pivot arm 30.

The storage container 20 is mounted to the second end 32B of the pivot arm 30. By "mounted", it is understood that the storage container 20 may be a separate object for storage that is attached to the pivot arm 30, or that the storage container 20 is integral with the pivot arm 30. For example, in FIGS. 6A and 6B, the storage container 20 is integral with the pivot arm 30 because the body of each pivot arm 30 at its second end 32B defines one of the interconnected walls 26 of the storage container 20. The storage container 20 in operation pivots with the pivot arm 30 about a pivot axis 34A. The storage container 20 and the pivot arm 30 are displaced together without any relative movement. The storage container 20 does not pivot, rotate or displace relative to the second end 32B of the pivot arm 30. The storage container 20 moves with the pivot arm 30 without any relative motion therebetween. This relationship between the storage container 20 and the pivot arm 30 allows the orientation of the storage container 20 to change as it is pivoted about the pivot axis 34A. Referring to FIG. 6A, in the stored position, the orientation of the storage container 20 allows it to define a basket or bucket for supporting the items 11 in the storage container interior 24, which remain inaccessible because of their overhead position. Referring to FIG. 6B, in the accessible position, the orientation of the storage container 20 is different than in the stored position, and allows it to define a cubbyhole or accessible compartment so that the items 11 are readily accessible to the occupant.

Referring to FIGS. 6A, 6B and 7, the pivot arms 30 are visible to an occupant of the residential living unit 12 at least when pivoting from the stored position to the accessible positon. In the stored position, the pivot arms 30 may be recessed or hidden within slots in the adjacent wall 12C, or the pivot arms 30 may be concealed by upright portions of the overhead structure 14.

The first end 32A of the pivot arm 30 is pivotably mounted to a fixed pivot 34 which defines the pivot axis 34A. The pivot 34 is immobile. The pivot 34 does not move within the residential living unit 12. The pivot 34 is immobile relative to the walls 12C, the overhead structure 14 and the overhead storage area 16. The pivot 34 is beneath the storage container 20 when the storage container 20 is in the stored position. Different embodiments of the pivot 34 which permit such functionality are within the scope of the present disclosure.

Referring to FIG. 6B, the pivot 34 is at approximately the same height, measured from the floor 12A, as the conforming wall 27C of the storage container 20 when it is in the accessible position. In FIGS. 6A and 6B, a height of the pivot 34, measured from the floor 12A, is less than six feet. In FIGS. 6A and 6B, a height of the pivot 34, measured from the floor 12A, is greater than three feet and less than four feet. In FIGS. 6A and 6B, a height of the pivot 34, measured from the floor 12A, is less than a height of the average adult female human. The height of the pivot 34, measured from the floor 12A, may be low enough for a person seated in a wheelchair to access the items 11 in the storage container 20 in the accessible position. In FIGS. 6A and 6B, the pivot 34 is located closer to the floor 12A than an uppermost surface of the lower structure 15. The lower or more accessible height of the pivot 34 allows the storage container 20 to pivot down to the height of the pivot 34, and thus to a more accessible height for the occupant when the storage container 20 is in the stored position. In FIGS. 6A and 6B, the pivot 34 is disposed immediately adjacent to the nearest upright wall 12C of the residential living unit 12. Positioning the pivot 34 as close as mechanically possible and feasible to the nearest wall 12C allows for the longest possible geometric lever arm, and allows the pivot 34 to be located closer to the floor 12A. Positioning the pivot 34 as close as mechanically possible and feasible to the nearest wall 12C makes it easier to conceal the pivot 34 thereby helping to improve aesthetics. Positioning the pivot 34 as close as mechanically possible and feasible to the nearest wall 12C helps to reduce the load that must be borne by the pivot 34 and any of its support structure, since placing the pivot further from the wall 12C increases the moment load on any structure linking the pivot 34 to the walls 12C.

Referring to FIGS. 6A and 6B, the pivot 34 is fixedly mounted to the lower structure 15, and is also disposed immediately adjacent to the nearest upright wall 12C of the residential living unit 12. The pivot 34 is an elongated bar or linkage that extends through a side wall of the Murphy bed 15A and through the body of the pivot arm 30 at the first end 32A. The pivot 34 may be any other suitable mechanical structure. For example, the pivot 34 may be or include a ball bearing. The pivot 34 is thus mounted to the lower structure 15 rather than to the wall 12C nearest the pivot 34, but still in close proximity to the wall 12C. This allows the storage container 20 to move in relation to the lower structure 15. For example, and as shown in FIG. 6B, the storage container 20 is pivoted from the stored position downward such that it is disposed in front of the lower structure 15 when it is in the accessible position. The depth of the back wall 27B of the storage container 20, as measured from the nearest wall 12C that is parallel to the back wall 27B, is greater than a depth of a front surface of the lower structure 15 measured from the same wall 12C. The pivot arm 30 has a length L measured parallel to the arm axis 31 and defined between the first and second ends 32A,32B. The length L of the pivot arm 30 is greater than a distance D between a front surface of the lower structure 15 and the wall 12C against which the lower structure 15 is positioned. In FIGS. 6A and 6B, the length L of the pivot arm 30 is thus related to a distance of the storage container 20 from the lower structure 15 in the accessible position. This relationship helps the pivot arm 30 to pivot the storage container 20 in front of the lower structure 15. The storage container 20 thus pivots downwardly over and in front of the lower structure 15 in the accessible position. It is therefore not necessary to displace the walls 12C, lower structure 15, or furnishings on the floor 12A to access the items 11 in the storage container 20. Referring to FIGS. 6A and 6B, the storage container 20 has a lowermost limit position that is above the bottom of the lower structure 15, such that the storage container 20 never pivots downwardly to be underneath or at a lower level than the lower structure 15. The lowermost limit position may be established with a mechanical stop or brake.

In an alternate embodiment, the pivot 34 is fixedly mounted to structure other than the lower structure 15. For example, the pivot 34 may be mounted to the nearest wall 12C against which the lower structure 15 is backed or rests. The pivot 34 may be mounted directly to a stud supporting the wall 12C, or indirectly to a bracket protruding from the wall 12C.

In some configurations, and referring to FIG. 6A, in the stored position, the storage container 20 is above and aligned with the lower structure 15. In FIG. 6A, the depth of the storage container 20 from the wall 12C in the stored position is the same as the depth of the lower structure 15 from the same wall 12C. When in the stored position, the storage container 20 may not protrude past the lower structure 15 and thus form a more aesthetically pleasing relationship with the lower structure 15. When pivoted from the lower accessible position to the stored position, the storage container 20 may be pivoted above and in line with the lower structure 15. In FIG. 6A, a vertical distance VD separates the back wall 27B of the storage container 20 from an uppermost surface of the Murphy bed 15A. One or more of the interconnected walls 26 of the storage container 20, such as the conforming wall 27C, may be visibly similar to observable surfaces of the lower structure 15, such as by having the same or similar surface finish or color.

Referring to FIG. 6A, the lower structure 15 may have one or more doors 15B, such as a cabinet door, that open into the interior space 12E. The storage container 20 is positioned on the pivot arm 30 such that when the storage container 20 is disposed in front of the lower structure 15 in the accessible position, the back wall 27B of the storage container 20 is spaced in front of the lower structure 15 a distance greater than a corresponding dimension of the doors 15B when they are open. In such a configuration, it is possible to open the doors 15B of the lower structure 15 even when the storage container 20 is positioned in front of the lower structure 15.

FIGS. 5A-6A show features of the storage container 20 in the stored position. The storage container 20 is disposed within the overhead storage area 16. The overhead storage area 16 is thus concealed by the storage container 20 when the storage container 20 is not being accessed. The storage container 20 is also adjacent to the overhead structure 14. The storage container 20 and the overhead structure 14 are at the same height measured from the floor 12A. The storage container 20 is mounted in proximity to the ceiling 12D. The storage container 20 is spaced immediately beneath the ceiling 12D sufficiently to allow for the pivoting movement of the storage container 20. One non-limiting example of dimensions for the storage container 20 are a height of 18 in. and a depth of 36 in. The conforming wall 27C is substantially upright. By "substantially", it is understood that the magnitude of its vertical vector is much greater than the magnitude of its horizontal vector. The conforming wall 27C is continuous with the upright visible wall 14A of the overhead structure 14. When the storage container 20 occupies the overhead storage area 16, there is an absence of any observable gap between the conforming wall 27C and the adjacent upright visible wall 14A. When the storage container 20 occupies the overhead storage area 16, there is a seamless visual transition between the conforming wall 27C and the adjacent upright visible wall 14A. Furthermore, the conforming wall 27C visually conforms to the upright visible wall 14A. By "visually conform", it is understood that the conforming wall 27C appears similar or identical to the upright visible wall 14A. The conforming and upright visible walls 27C,14A thus appear to blend together when the storage container 20 occupies the overhead storage area 16. The conformity between the conforming wall 27C and the upright visible wall 14A in the stored position thus allow the storage container 20 and the overhead structure 14 to appear as a continuous and singular structure to an occupant of the residential living unit 12. The conforming wall 27C may thus give the impression that the storage container 20 in the stored position is part or, or an extension of, the visible portion of the overhead structure 14.

Different configurations and arrangements are possible for achieving the conformity between the conforming wall 27C and the upright visible wall 14A of the overhead structure 14. For example, and referring to FIGS. 5A and 5B, the conforming wall 27C has the same vertical length as the upright visible wall 14A. In FIGS. 5A and 5B, the conforming wall 27C has one or more of the same color, pattern, and texture as the upright visible wall 14A. Other interconnected walls 26 of the storage container 20 may also conform to other visible structure of the overhead structure 14. For example, and referring to FIG. 6A, the back wall 27B and bottom surface 27BS are visible when the storage container 20 is in the stored position. In such a configuration, a corresponding lower or bottom wall 14B of the overhead structure 14 that is adjacent to the back wall 27B also conforms to the back wall 27B, such as by having the same depth, colour or pattern, to thereby reinforce the appearance of continuity and congruity between the storage container 20 and the adjacent overhead structure 14 in the stored position.

It can thus be appreciated that since the conforming wall 27C is one of the few, or the only, interconnected walls 26 that is visible in the stored position, the conforming wall 27C operates to conceal, match, harmonize, camouflage, or blend the storage container 20 with the adjacent overhead structure 14 (e.g. a cabinet 14', a bulkhead 14", a suspended part 14''' of the ceiling 12D, etc.). The conforming wall 27C thus helps the storage container 20 to appear part of, or contiguous with, the adjacent overhead structure 14. The conforming wall 27C also conceals or hides the items 11 in the storage container 20 when it is in the stored position. In the stored position, the conforming wall 27C thus prevents or obstructs the occupant from viewing or observing the items 11 in the storage container interior 24 when the occupant is within the space 12E.

The conformity between the storage container 20 and the adjacent overhead structure 14 in the stored position contributes to the aesthetic of the residential living unit 12 both because the items 11 of the storage container 20 are hidden from view by the conforming wall 27C, and the storage container 20 appears to be part of the structure of the residential living unit 12. This may allow for the storage container 20 to be used in settings where design and look are important, such as in living areas of residential rooms or the interior of commercial showrooms.

FIG. 6B shows features of the storage container 20 in the accessible position. The storage container 20 is disposed below the overhead storage area 16. The storage container 20 is disposed closer to the floor 12A than the overhead structure 14. The storage container 20 and the items 11 are suspended in proximity to the floor 12A of the residential living unit 12 at a lowered position that is comfortable for the occupant to load and unload the items 11 from the storage container 20. The conforming wall 27C reveals the storage container interior 24, and allows access to the items 11 therein. In the lowered and accessible position, the conforming wall 27C is substantially horizontal. By "substantially", it is understood that the magnitude of its horizontal vector is much greater than the magnitude of its vertical vector. For example, and as shown in FIG. 6B, the conforming wall 27C, forms a relatively small angle relative to a horizontal plane. The angle may be greater than zero degrees and less than twenty degrees. Such a substantially horizontal conforming wall 27C is thus inclined relative to the horizontal plane, and slopes downwardly toward the back wall 27B. This orientation of the conforming wall 27C helps to reduce the possibility of the items 11 sliding out of the storage container 20 when it transitions to the accessible position. The substantially horizontal conforming wall 27C forms a shelf to help the occupant examine, sort, rearrange and/or store the items 11. The change in orientation experienced by the conforming wall 27C when pivoting to the accessible position allows the storage container 20 to remain free of a door or other similar barrier that controls access to the storage container interior 24. Instead, access to the storage container interior 24 is provided by the simple change in orientation experienced by the conforming wall 27C. The occupant is thus not required to open or close a door to hide/contain the items 11 in the storage container 20 or to obtain access thereto. The occupant is also not required to remember to close a door when placing the items 11 in the storage container 20 because the changing orientation of the conforming wall 27C as it pivots toward the stored position will function to maintain the items 11 within the storage container interior 24. This contributes to the user friendliness of the storage container 20 and its safety.

Referring to FIGS. 6B and 8C, an entirety of the storage container interior 24 is accessible in the accessible position. The storage container 20 is open along all of its frontage. The entire width and height of the storage container interior 24 is accessible to the occupant in the accessible position. In an alternate embodiment, only part of the storage container interior 24 is accessible in the accessible position.

Figure 8A:
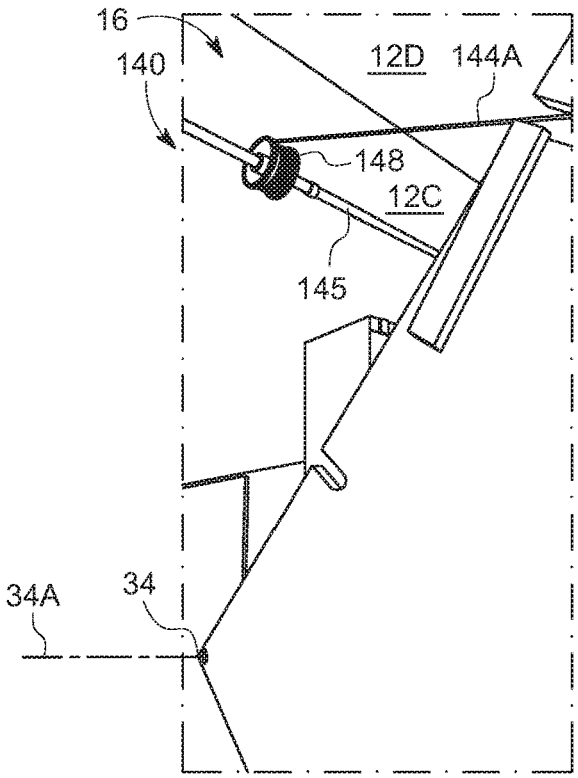
FIG. 8A is a perspective view of a motor of the overhead storage unit of FIG. 5A.
Figure 8B:
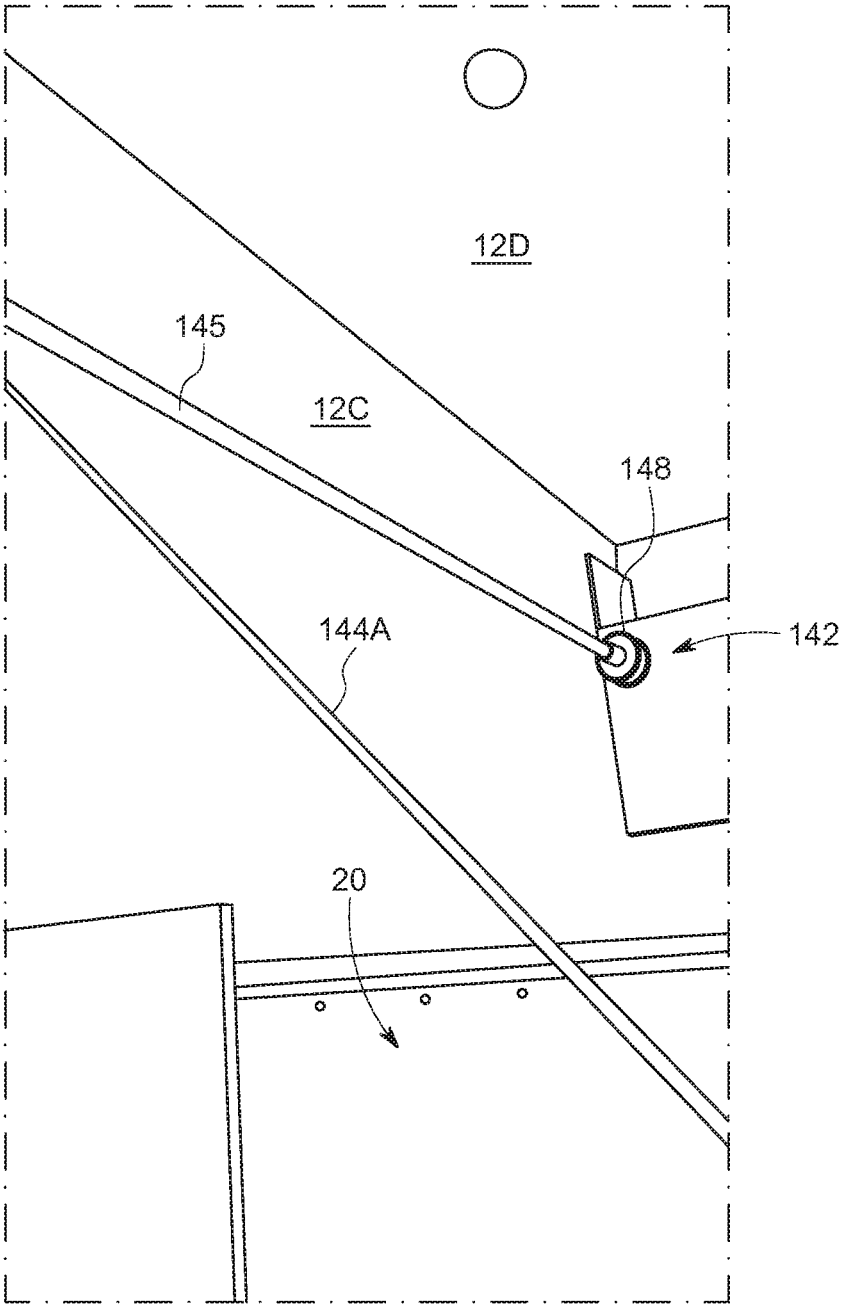
FIG. 8B is a perspective view of a pully with a wound cable displaceable by the motor of FIG. 8A.
Figure 8C:
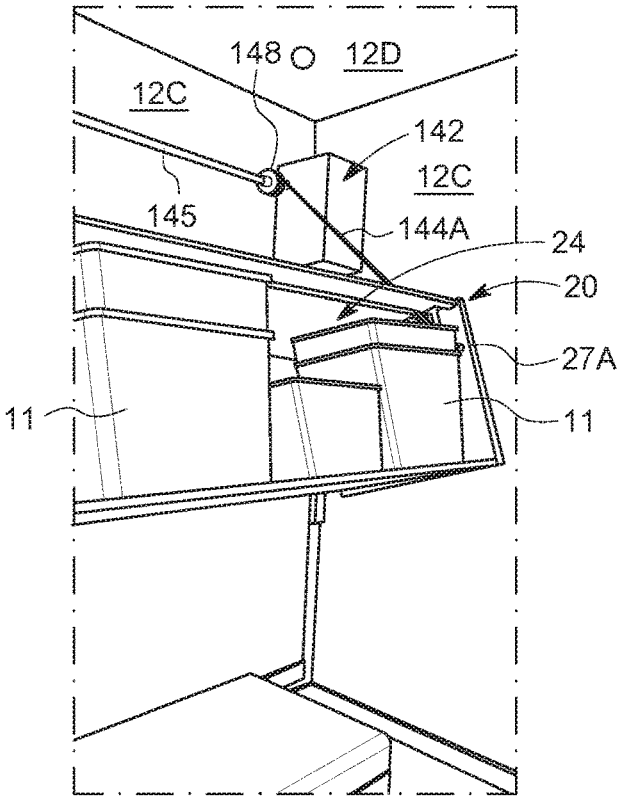
FIG. 8C is another perspective view of the pully and the wound cable of FIG. 8C.
Figure 9:
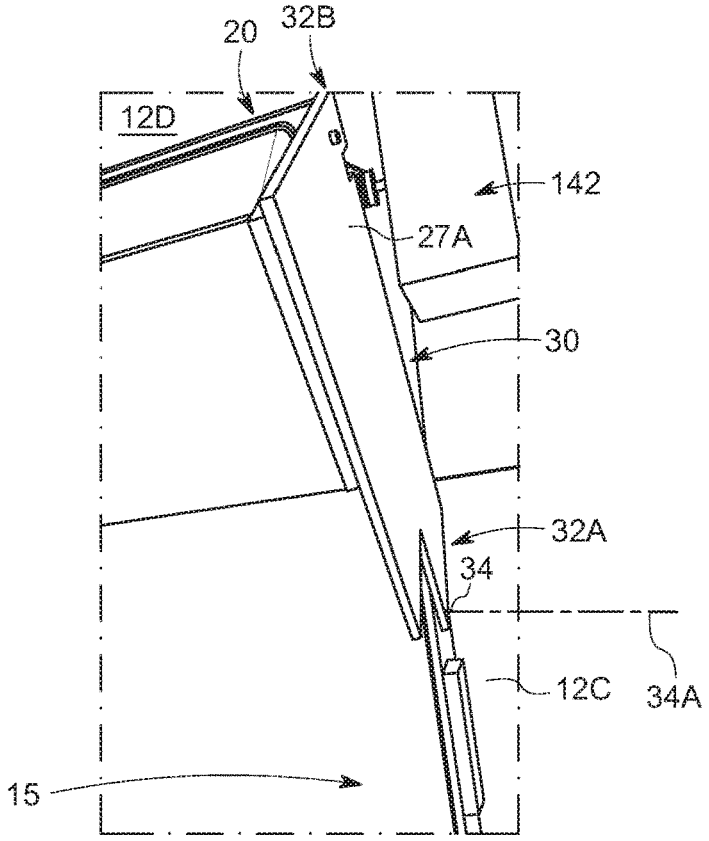
FIG. 9 is another perspective view of the overhead storage unit of FIG. 5A, showing the storage container transitioning between the stored position and the accessible position.

Referring to FIGS. 8A to 8C, the displacement of the storage container 20 may be performed manually by the occupant, or with the assistance of motive power. In FIGS. 8A to 8C, the storage unit 10 includes a motive power source. More particularly, the storage unit 10 has a motor assembly 140, another embodiment of which is shown in FIGS. 8A to 8C. The motor assembly 140 provides motive power to the storage container 20 to displace it between the stored and accessible positions. In the depicted embodiment, and to optimise available space, the motor assembly 140 is mounted in the overhead storage area 16 adjacent to the overhead structure 14. Acoustic tiles may be mounted adjacent to the motor assembly 140, and may be removed to service the motor assembly 140. The motor assembly 140 includes a motor 142. Suitable brackets or mountings can be provided to secure the motor 142 in place, such as to the wall 12C. The motor 142 drivingly engages one or more displacement members 144A. The displacement members 144A are mounted to the storage container 20 to displace it between the stored and accessible positions. The motor 142 may be controlled manually with a switch, or from a distance with a remote in communication with the motor 142 to control actuation thereof. The motor 142 may have a gearbox. The motor 142 may have a crank to be manually operated.

In the embodiment of FIGS. 8A to 8C, the displacement members 144A include motor cables 144A. The motor cables 144A are wound about one or more pulleys 148 which are mounted for rotation with a drive shaft 145 driven by the motor 142. Rotation of the pulley 148 causes the motor cables 144A to spool and unspool. An end of each motor cable 144A is attached to the storage container 20 so that the spooling and unspooling of the motor cables 144A will cause the storage container 20 to pivot about the pivot axis 34A.

The displacement of the storage container 20 with the motor assembly 140 occurs as follows. To lower the storage container 20 from the stored position where it has the first orientation, the motor 142 drives the drive shaft 145 and performs a controlled unspool of the motor cables 144A by rotating to unwind the motor cables 144A. This provides slack in the motor cables 144A allowing the storage container 20 to pivot downwardly based on gravity. To raise the storage container 20 from the accessible position, the motor 142 draws in the motor cables 144A by rotating to spool them about the pulley 148. This removes slack from the motor cables 144A and applies tension thereto, causing the storage container 20 to pivot upward about the pivot axis 34A.

Other techniques are within the scope of the present disclosure for displacing the storage container 20. In an alternate embodiment, the motive power is supplied by any other suitable type of drive, including, but not limited to, a crank with a manual mechanism and/or a spring balance. In an embodiment, the storage unit 10 includes a sensor to monitor displacement of the storage container 20, and to prevent the storage container 20 from being lowered too far, or from contacting an object while being raised or lowered. Similarly, the storage unit 10 may include a stop member to limit the downward displacement of the storage container 20.

Figure 11A:
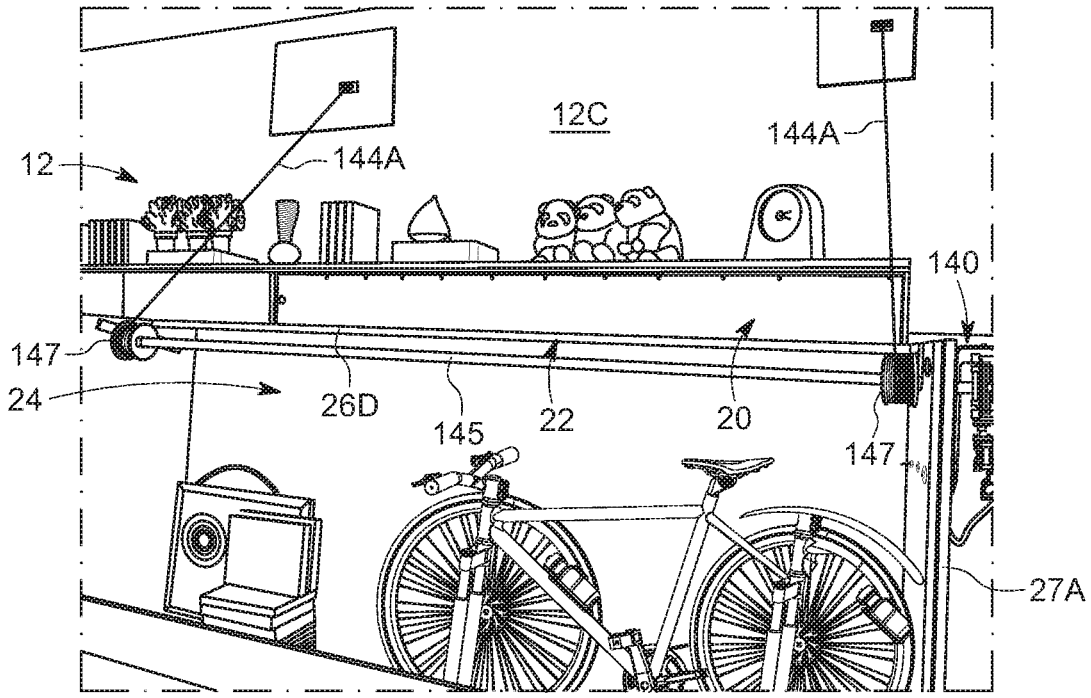
FIG. 11A is a perspective view of the residential living unit having another configuration of the motor.

One such other technique for displacing the storage container 20 is shown in FIGS. 11A to 110, which shows another embodiment of the motor assembly 140. The motor 142 of the motor assembly 140 is mounted to the outer surface of one of the side walls 27A of the storage container 20. The motor 142 is disposed between the side wall 27A and one of the walls 12C of the residential living unit 12. The motor 142 is functional to displace the storage container 20 between the stored and accessible positions. The motor 142 displaces with the storage container 20 about the pivot axis 34A. The output of the motor 142 rotationally drives a drive shaft 145 which is mounted to spools 147 which rotate with the drive shaft 145 about an axis defined by the drive shaft 145. There is no slip between the drive shaft 145 and the spools 147 mounted thereto. The spools 147 and the drive shaft 145 displace with the storage container 20 about the pivot axis 34A. A cable 144A is wound about each of the spools 147 and is secured at one of its ends to one of the walls 12C. The displacement of the storage container 20 with the motor assembly 140 of FIGS. 11A to 11C occurs as follows. To lower the storage container 20 from the stored position where it has the first orientation, the motor 142 drives the drive shaft 145 and performs a controlled unspool of the motor cables 144A by rotating the spools 147 to unwind the motor cables 144A. This provides slack in the motor cables 144A allowing the storage container 20 to pivot downwardly based on gravity. To raise the storage container 20 from the accessible position, the motor 142 draws in the motor cables 144A by rotating the drive shaft 145 in an opposite direction to spool the motor cables 144A about the spools 147. This removes slack from the motor cables 144A and applies tension thereto, causing the storage container 20 to pivot upward about the pivot axis 34A.

Figure 11B:
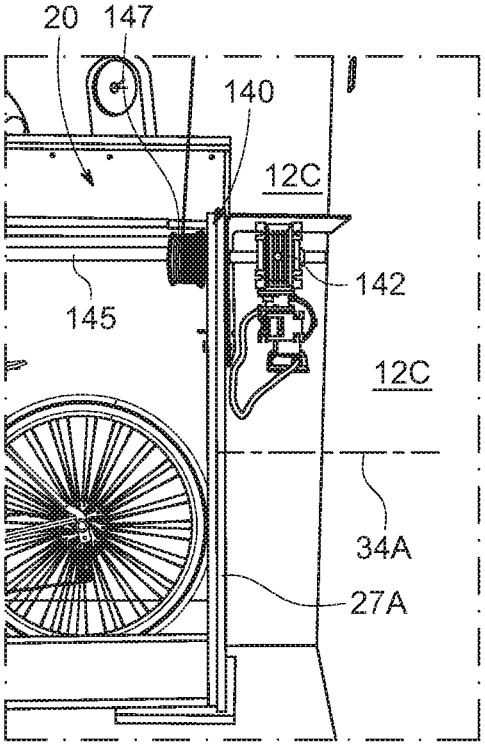
FIG. 11B is a perspective view of the motor of FIG. 11A.
Figure 11C:
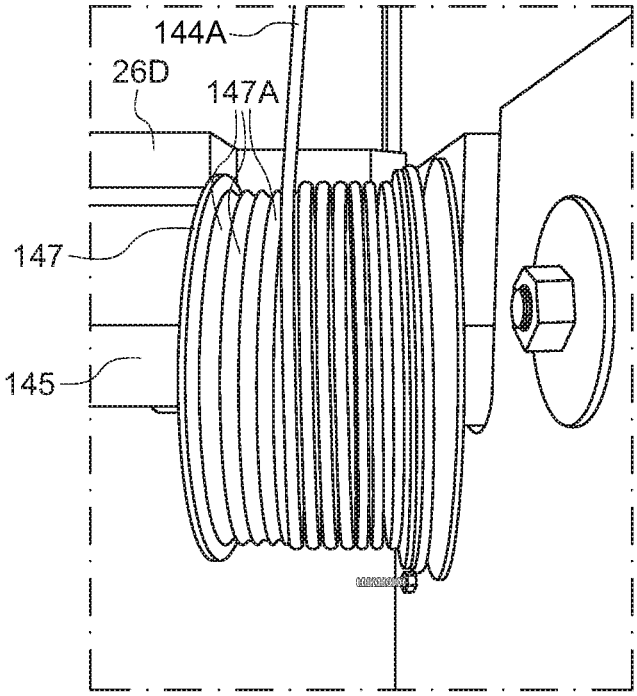
FIG. 11C is a perspective view of a spool driven by the motor of FIG. 11C.

Referring to FIGS. 11A to 11C, the drive shaft 145 and the spools 147 are positioned in the storage container interior 24 defined by the storage structure 22 of the storage container 20. The drive shaft 145 and the spools 147 are disposed near an upper and rear portion of the storage container interior 24 as defined when the storage container 20 is in the accessible position. This positioning of the drive shaft 145 and the spools 147 allows the boundary wall 26D of the storage container 20 to abut directly against the wall 12C when the storage container 20 is in the stored position. The spools 147 and/or the drive shaft 145 may be partially or fully encased to prevent access thereto when the storage container 20 is in the accessible position.

Referring to FIG. 11C, each of the spools 147 has grooves 147A spaced apart in a lateral direction and extending along the entire circumference of an outer surface of the spools 147. The grooves 147A are sized and shaped to receive therein portions of the cable 144A wound about the spools 147. By providing laterally-spaced apart positions for the portions of the cable 144A, the grooves 147A help to reduce or prevent the cable 144A from bunching up or overlapping itself as the spools 147 are rotated to raise and lower the storage container 20.

Other techniques are within the scope of the present disclosure for displacing the storage container 20. In one possible other technique, the motor 142 is fixedly mounted to or near the floor 12A, to drive the drive shaft 145 near the floor 12A. The motor 142 drives the drive shaft 145 to displace the cable 144A. The cable 144A runs upwardly from the drive shaft 145 or spools 147 thereof, around a pulley 148 positioned in the overhead storage area 16, and to an end of the cable 144A fixedly attached to the storage container 20. This configuration of the motor assembly 140 allows for portions thereof, such as the motor 140, the drive shaft 145, the spools 147 and/or the pulleys 148, to be stored behind the wall 12C and thus out of sight.

Referring to FIGS. 6A and 6B, there is disclosed a method of storing the items 11 in the overhead storage area 16. The method includes loading the items 11 in the storage container 20 mounted to the pivot arm 30 while the storage container 20 is beneath the overhead storage area 16. The method includes pivoting the pivot arm 30 and the storage container 20 upward and into the overhead storage area 16. A wall 27C of the storage container 20 becomes upright and continuous with the upright overhead structure 16, and/or with other visible structure of the overhead structure 14 like a bottom panel or wall. The wall 27C of the storage container 20 visually conforms with the upright overhead structure 14.

In embodiments, the residential living unit 12 is free of one or more overhead structures 14 adjacent to the storage container 20 in the stored position, and is free of one or more lower structures 15 beneath the storage container 20 in the stored position. In such embodiments, the storage container 20 may be positioned adjacent to only one wall 12C of the residential living unit 12 in the stored position, and spaced apart from other walls 12C of the residential living unit 12, such that the storage container 20 is not adjacent to structure on its lateral sides. In such embodiments, the storage container 20 may visibly stand-out in the residential living unit 12.

In embodiments, the residential living unit 12 is free of one or more overhead structures 14 adjacent to the storage container 20 in the stored position. In such embodiments, the overhead storage area 16 is defined above the lower structure 15 and beneath the ceiling 12D, and is not delimited on lateral sides by structure other than the walls 12C of the residential living unit 12. An example of such an embodiment is shown in FIGS. 12A-12D.

In FIGS. 12A-12D, the residential living unit 12 includes a variety of lower structures 15. All of the lower structures 15 are disposed beneath the storage container 120 of the overhead storage unit 110 when the storage container 120 is in the stored position (see FIGS. 12A and 12B). The lower structures 15 provide functionality to the different rooms or sections of the residential living unit 12. For example, the lower structures 15 include objects which provide functionality to the kitchen, such as a sink 15C, a stove 15D, a fridge 15E, and kitchen cabinets 15F. The lower structures 15 also include the Murphy bed 15A, and a couch or ottoman 15G, to provide function to the living room cum bedroom. The lower structures 15 may be mounted to, and supported by, one or more of the walls 12C, and/or may be supported by the floor 12A. It will be appreciated that the residential living unit 12 may have more or fewer lower structures 15.

Some of the lower structures 15, such as the kitchen cabinets 15F, the fridge 15E, and the stove 15D, may have one or more doors that open into the interior space 12E. The storage container 120 is positioned on the pivot arms 130 such that when the storage container 120 is disposed in front of the lower structures 15 in the accessible position, the back wall 127B of the storage container 120 is spaced in front of the lower structures 15 a distance greater than a corresponding dimension of the doors when they are open. In such a configuration, it is possible to open the doors of the lower structures 15 even when the storage container 120 is positioned in front of the lower structures 15.

Referring to FIGS. 12A-12D, the residential living unit 12 is free of overhead structure 14 that is adjacent to, and partially delimits, the overhead storage area 16. The overhead storage area 16 extends between opposed walls 12C of the residential living unit 12. The "opposed" walls 12C are walls 12C which are parallel with each other, and which are spaced apart from each other by a linear distance of the interior space 12E of the residential living unit 12. Only one of the opposed walls 12C is shown in FIGS. 12A-12D. The overhead storage area 16 has an uppermost boundary at the ceiling 12D, and extends downwardly therefrom toward the floor 12A until a lowermost boundary defined by the lower structures 15, and is bounded on its sides by the walls 12C. Referring to FIGS. 12A-12D, the lowermost boundary of the overhead storage area 16 defined by the lower structures 15 has a uniform height defined by the upper surfaces of the lower structures 15. The lowermost boundary of the overhead storage area 16 defined by the lower structures 15 is the same height, measured from the floor 12A, across the whole distance between the opposed walls 12C. The overhead storage area 16 may thus span or extend across the entire distance between two opposed walls 12C.

Figure 12A:
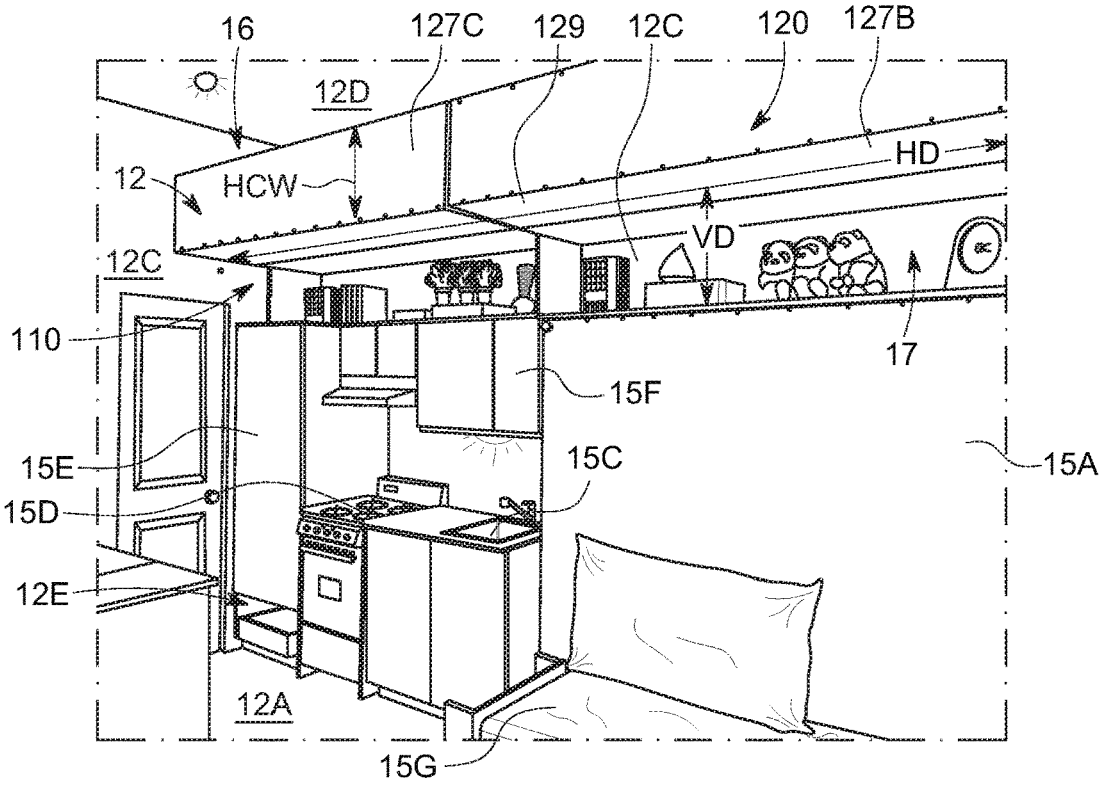
FIG. 12A is a perspective view of another residential living unit having another overhead storage unit.
Figure 12B:
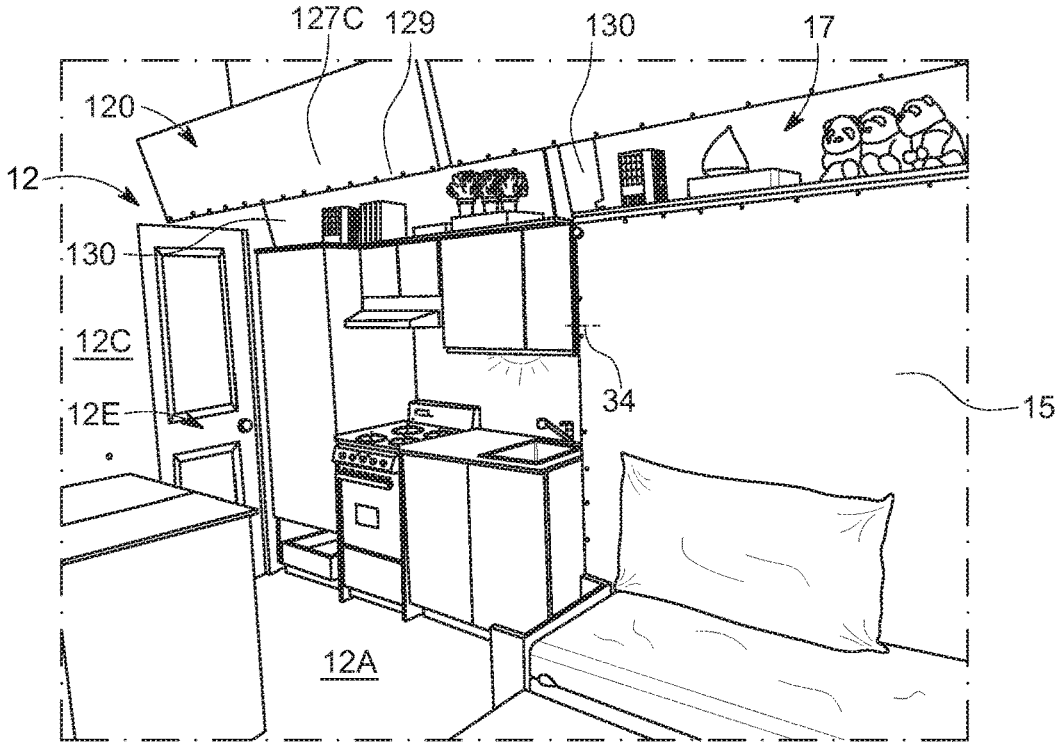
FIG. 12B is another perspective view of the overhead storage unit of FIG. 12A, being displaced from a stored position to an accessible position.
Figure 13:
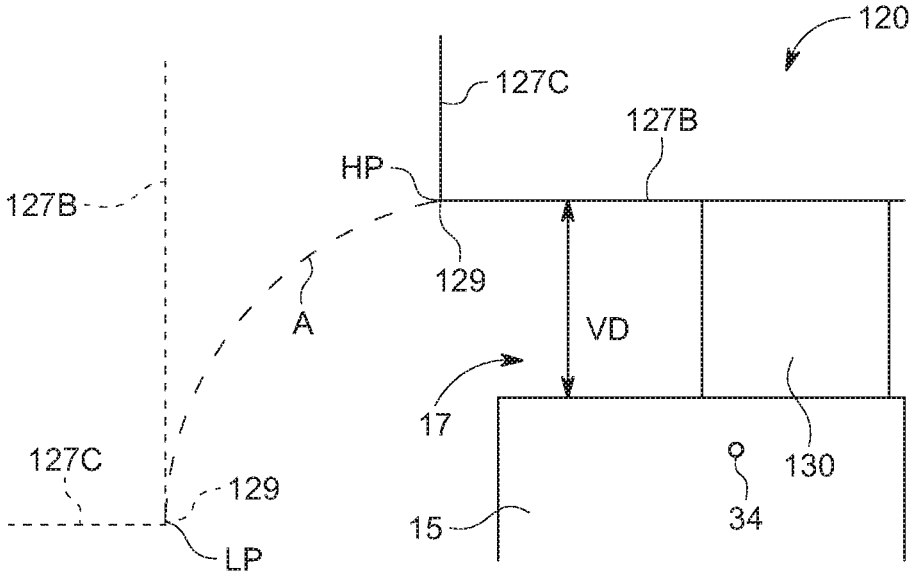
FIG. 13 is a schematic side view of part of the overhead storage container displacing between the stored and accessible positions.

Referring to FIGS. 12A and 12B, a gap 17 is defined between the lower structures 15 and the storage container 120 when the storage container 120 is in the stored position. The gap 17 is a portion or volume of the overhead storage area 16 that remains unoccupied by the storage container 120 in the stored position. The gap 17 has the vertical distance VD described above, and a horizontal distance HD. The horizontal distance HD of the gap 17 is defined between the opposite walls 12C of the residential living unit 12. The magnitude of the horizontal distance HD is greater than the magnitude of the vertical distance VD. The vertical distance VD is defined between the back wall 127B of the storage container 120 to an uppermost surface of the lower structures 15. The vertical distance VD is uniform throughout the horizontal distance HD between the opposed walls 12C. The gap 17 is a space between the bottom of the storage container 120 and a top of one or more lower structures 15 that allows the storage container 120 to clear the lower structure 15 when pivoting from the stored position to the accessible position. The gap 17 is sized such that a leading edge 129 of the storage container 120, defined at the intersection of the conforming wall 127C and the back wall 127B, is able to clear the one or more lower structures 15 in the path of pivoting movement followed by the storage container 120. Referring to FIG. 13, the leading edge 129 is spaced sufficiently far by the gap 17 from the lower structure 15 that it is able to move along a continuously downward arc A about the pivot 34. The arc A defined by the leading edge 129 has its highest point HP in its initial position when the storage container 120 is in the stored position. The arc A has its lowest point LP when the leading edge 129 is in its final position when the storage container 120 is the accessible position. The leading edge 129 does not rise above the highest position HP as it travels along the arc A. Non-limiting examples of the vertical distance VD for the gap 17 include approximately 1 to 1.5 ft. The gap 17 also provides a display area or zone above the lower structures 15, where display objects may be visible in the gap 17, and may be mounted to the wall 12C or supported on the upper surface of the lower structures 15.

Referring to FIGS. 12A-12D, the storage container 120 extends between the opposed walls 12C of the residential living unit 12. The storage container 120 extends between, and spans, the entire distance between the opposed walls 12C of the residential living unit 12. A side wall 127A of the storage container 120 is immediately adjacent to one of the opposed walls 12C, and another side wall 127A is immediately adjacent to the other opposed wall 12C. The side walls 127A of the storage container 120 define planes that are parallel to planes defined by the opposed walls 12C. In an embodiment, the storage container 120 extends between, and spans, a distance of approximately 14 feet between the opposed walls 12C. Referring to FIG. 12A, some of the overhead storage area 16 is concealed or occupied by the storage container 120 when the storage container 120 is in the stored position, and the remaining portion of the overhead storage area 16 that is unoccupied is the gap 17.

Figure 12C:
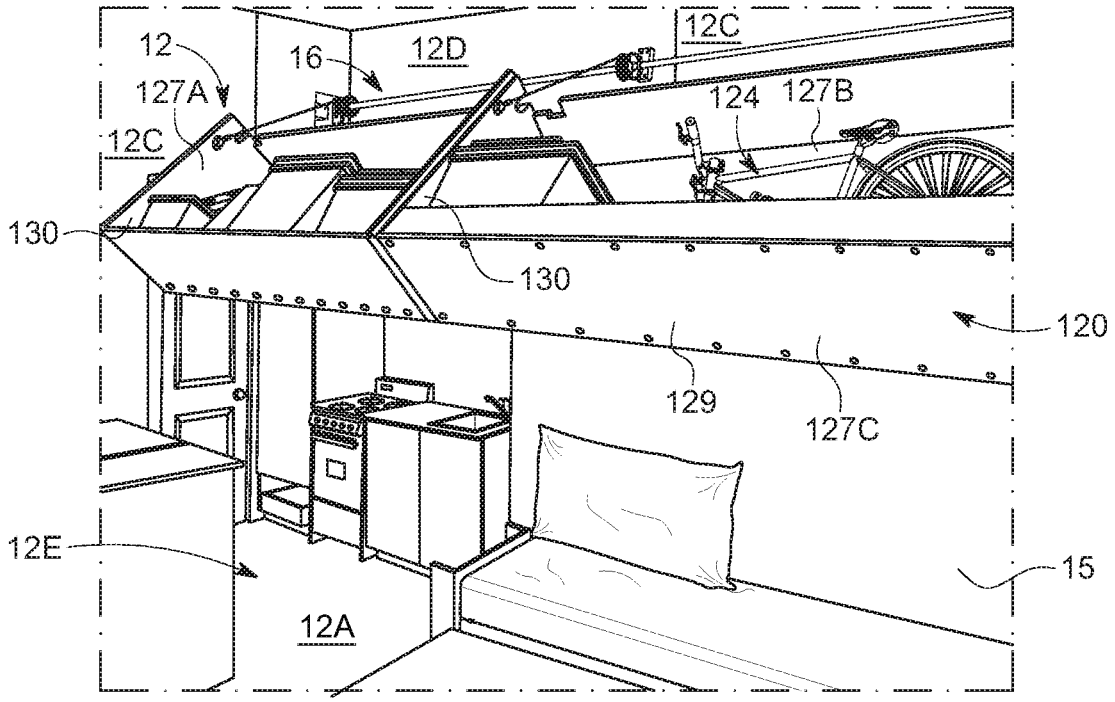
FIG. 12C is another perspective view of the overhead storage unit of FIG. 12A, being further displaced from the stored position to the accessible position.
Figure 12D:
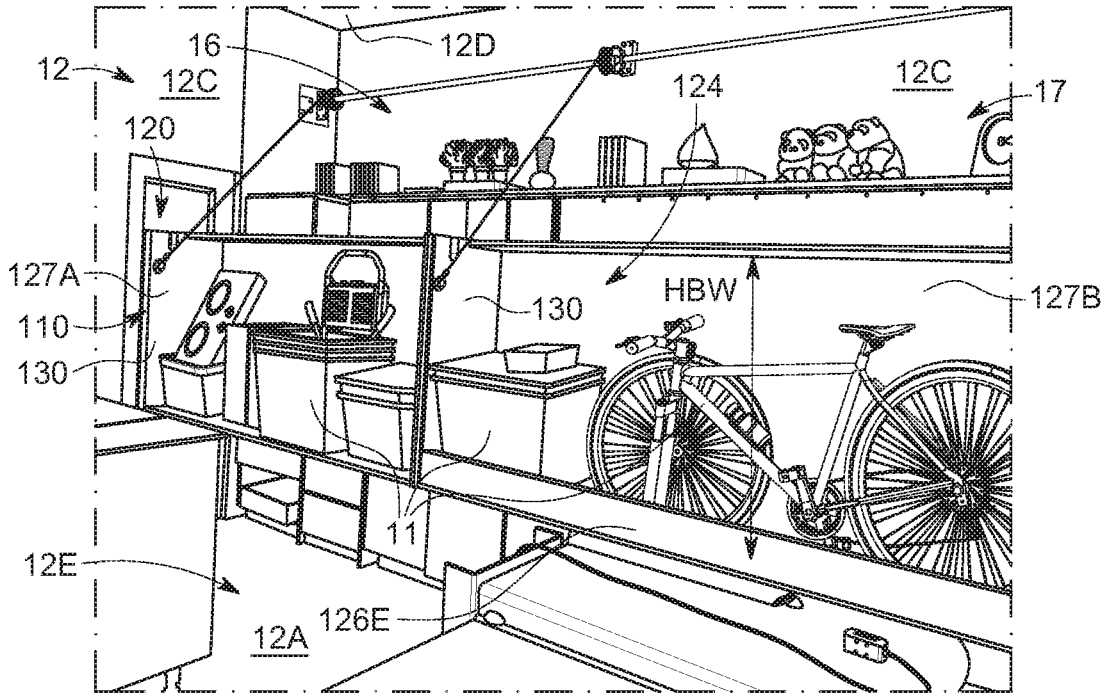
FIG. 12D is another perspective view of the overhead storage unit of FIG. 12A in the accessible position.

Referring to FIGS. 12B and 12C, the storage container 120 has a long conforming wall 127C that extends between, and spans, the entire distance between the opposed walls 12C of the residential living unit 12. The back wall 127B is perpendicularly connected to the conforming wall 127C. In the accessible position, and referring to FIG. 12D, the back wall 127B is substantially upright, and the back wall 127B is substantially horizontal in the stored position (see FIG. 12A). A height HBW of the back wall 127B is defined when the storage container 120 is in the accessible position (see FIG. 12D). The height HBW of the back wall 127B is greater than a height HCW of the conforming wall 127C when the storage container 120 is in the stored position (see FIG. 12A). In one possible and non-limiting configuration, the height HBW of the back wall 127B is about 3 feet, and the height HBC of the conforming wall 127C is between about 1 and about 1.5 feet. The differences in height between the back wall 127B and the conforming wall 127C, along with the changing orientation of these walls 127B,127C as they are displaced between the stored and accessible positions, helps to define a configuration of the storage container 120 which allows it to be "tall" when it is in the accessible position and thus able to accommodate taller items 11 (see FIG. 12D), while also allowing the storage container 120 to have a small vertical profile in the stored position so that it is less conspicuous (see FIG. 12A). Referring to FIG. 12A, the differences in height between the back wall 127B and the conforming wall 127C allows the storage container 120 to "stick out" more from the adjacent wall 12C than it is tall in the stored position. The conforming wall 127C may the smallest dimension needed to conceal the stored items 11 when the storage container 120 is in the stored position. Referring to FIGS. 12C and 12D, the storage container 120 has a barrier wall 126E which extends perpendicularly from a free end of the conforming wall 127C and into the storage container interior 124. The barrier wall 126E has an upright orientation in the accessible position. The barrier wall 126E has a height defined in the accessible position that is less than the height HBW of the back wall 127B. The barrier wall 126E has a height defined in the accessible position that is less than a third of the height HBW of the back wall 127B. The barrier wall 126E forms a lip of the storage container 120 in the accessible position to help retain the items 11 in the storage container interior 124. In the stored position, the conforming wall 127C is substantially upright and its free, uppermost end is in close proximity to the ceiling 12D.

Referring to FIGS. 12A-12D, the pivot arm 130 is similar to the pivot arm 30 described above, and thus the description of the features and functions of the pivot arm 30 apply mutatis mutandis to the pivot arm 130. The storage unit 110 has three pivot arms 130. Portions of two of the pivot arms 130 form the side walls 127A of the storage container 120. Referring to FIGS. 12C and 12D, the third pivot arm 130 forms a dividing wall that divides the storage container interior 124 into two parts. Each part of the storage container interior 124 may be used differently. For example, one part of the storage container interior 124 may be used to store the items 11, while another part may include a desk and a chair and be used as an office space. Referring to FIG. 12A and 8B, part of third pivot arm 130 is exposed and appears as a dividing wall for the display area or zone above the lower structures 15 when in the stored position. A remainder of the third pivot arm 130 is concealed between adjacent lower structures 15. Referring to FIG. 12B, the pivot 34 is at a greater height, measured from the floor 12A, than the conforming wall 127C of the storage container 120 when it is in the accessible position. The pivot 34 is at a lower height, measured from the floor 12A, than the conforming wall 127C of the storage container 120 when it is in the stored position. The pivot 34 is located closer to the floor 12A than an uppermost surface of all of the lower structures 15.

The storage container 120 is disposed immediately beneath the ceiling 12D in the stored position (see FIG. 12A). The immediate proximity of the storage container 120 to the ceiling 12D helps it to appear like an immobile structure in the residential living unit 12. The proximity of the storage container 120 to the walls 12C and ceiling 12D in the stored position contributes to the aesthetic of the residential living unit 12 both because the items 11 of the storage container 120 are hidden from view by the conforming wall 127C, and the storage container 120 appears to be part of the structure of the residential living unit 12.

The description above in relation to FIGS. 1A-11C of the features, functions and benefits of the residential living unit 12, the lower structure 15, the overhead storage area 16 and the storage unit 10 applies mutatis mutandis to the residential living unit 12, the lower structures 15, the overhead storage area 16 and the storage unit 110 shown in FIGS. 12A-12D.

In light of the preceding, it can be appreciated that the storage unit 10,110 has a storage container 20,120 that is storable in an overhead position, which can be lowered and raised, and whose movements transforms the orientation of the storage container 20,120 between the stored and accessible positions. When used in a relatively small residential living unit 12, the storage unit 10,110 helps to minimise the space occupied by the items 11 that need to be stored. In the accessible position, the storage container 20,120 can be lowered to a convenient height to facilitate loading and unloading, thereby eliminating the necessity and inconvenience of a step ladder and potential injuries that may result should the occupant fall off the step ladder. By facilitating the storage and easy retrieval of items 11, the storage unit 10,110 helps to increase the available living space of the relatively small residential living unit 12. The storage unit 10,110 may also allow the occupant to store heavy items 11 overhead that may otherwise be difficult or impossible to store overhead using only a step ladder.

The embodiments described in this document provide non-limiting examples of possible implementations of the present technology. Upon review of the present disclosure, a person of ordinary skill in the art will recognize that changes may be made to the embodiments described herein without departing from the scope of the present disclosure. For example, the descriptive terms "horizontal", "vertical", and "upright" used herein do not limit the feature to being perfectly level or perfectly normal to a level plane. These features can deviate from the level and from the vertical provided that they remain substantially horizontal or vertical. Similarly, although the storage unit 10,110 is disclosed herein as being part of a residential living unit 12, it will be appreciated that the storage unit 10,110 may be used in other types of building units, such as commercial or industrial units. Furthermore, the storage unit 10,110 may be provided as a kit or as parts unassembled, which may be assembled and installed in an existing residential living unit 12 as part of a retrofit. Yet further modifications could be implemented by a person of ordinary skill in the art in view of the present disclosure, and such modifications would be within the scope of the present technology.

The invention claimed is:

1. A residential living unit, comprising:

a ceiling, a floor and upright walls delimiting a space, some of the space beneath the ceiling being an overhead storage area, a rear upright wall of the upright walls delimiting the space defining a rear boundary of the overhead storage area;

an overhead storage unit, comprising:

a pivot arm extending from a first end to a second end, the first end pivotably mounted to a pivot remaining stationary within the residential living unit, and the pivot arm pivotable about a pivot axis defined by the pivot; and a storage container having interconnected walls defining a storage container interior, one of the interconnected walls being a first wall, the storage container mounted to the second end of the pivot arm, the pivot arm forming at least part of one of the interconnected walls, and the storage container pivotable with the pivot arm to be raised and lowered between a stored position and an accessible position, in the stored position, the storage container is disposed within the overhead storage area and the first wall is upright, the storage container positioned at a first distance from the rear upright wall; and in the accessible position, the storage container is disposed below the overhead storage area and the first wall provides access to the storage container interior, the storage container positioned at a second distance from the rear upright wall greater than the first distance.

2. The residential living unit of claim 1, comprising a lower structure disposed in the space beneath the overhead storage area, the storage container disposed in front of the lower structure in the accessible position.

3. The residential living unit of claim 1, comprising a lower structure disposed in the space beneath the overhead storage area, the pivot fixedly mounted to the lower structure.

4. The residential living unit of claim 3, wherein the pivot is disposed immediately adjacent to one of the upright walls delimiting the space.

5. The residential living unit of claim 2, wherein the storage container is above and aligned with the lower structure in the stored position.

6. The residential living unit of claim 2, wherein the lower structure has one or more doors that fully open into the space, the storage container disposed in front of the lower structure in the accessible position and spaced in front of the lower structure a distance greater than a corresponding dimension of the doors of the lower structure when fully opened.

7. The residential living unit of claim 2, wherein the pivot arm has a length defined between the first and second ends, the length being greater than a distance between a front surface of the lower structure and the wall against which the lower structure is positioned.

8. The residential living unit of claim 2, wherein a gap is defined between the the lower structure and the storage container upon the storage container being in the stored position, the gap being sized to allow the storage container to clear the lower structure when pivoting from the stored position to the accessible position.

9. The residential living unit of claim 1, wherein a height of the pivot measured from the floor is less than six feet.

10. The residential living unit of claim 1, wherein the storage container extends between, and spans, an entire distance between opposed walls of the residential living unit.

11. The residential living unit of claim 1, wherein the interconnected walls of the storage container include a back wall perpendicularly interconnected with the first wall, the back wall being upright in the accessible position and being substantially horizontal in the stored position, the back wall having a height in the accessible position being greater than a height of the first wall in the stored position.

12. The residential living unit of claim 1, wherein the interconnected walls of the storage container include a back wall perpendicularly interconnected with the first wall, and the storage container has a barrier wall extending perpendicularly from a free end of the first wall into the storage container interior, the back and barrier walls having an upright orientation in the accessible position, a height of the barrier wall being less than half of a height of the back wall in the accessible position.

13. The residential living unit of claim 1, comprising an overhead structure positioned in proximity to the ceiling and having an upright visible wall, the overhead storage area defined adjacent to the overhead structure beneath the ceiling, wherein in the stored position, the storage container is disposed within the overhead storage area adjacent to the overhead structure, the first wall is upright and continuous with the upright visible wall of the overhead structure, and the first wall visually conforms with the upright visible wall.

14. The residential living unit of claim 1, wherein one of the walls has a door providing access to the space of the residential living unit, the storage container is disposed above the door in the stored position.

15. The residential living unit of claim 14, wherein, the storage container is disposed between an upper portion and a bottom portion of the door in the accessible position.

16. The residential living unit of claim 1, wherein upon the storage container being in the stored position, the pivot arm is upright and the pivot is spaced apart from the storage container and beneath the storage container by a distance being at least part of a length of the pivot arm defined between the first and second ends.

17. The residential living unit of claim 1, wherein the pivot arm has a body, the body near the second end of the pivot arm partially delimiting a storage container interior of the storage container.

18. A method of storing items in an overhead storage area delimited by a ceiling, a floor and upright walls, a rear upright wall of the upright walls defining a rear boundary of the overhead storage area, comprising:

loading the items in a storage container having interconnected walls defining an interior of the storage container, the storage container mounted to an arm while the storage container is beneath the overhead storage area and positioned at a distance from the rear upright wall corresponding to an accessible position of the storage container, the arm forming at least part of one of the interconnected walls, a wall of the interconnected walls of the storage container being horizontal and providing access to the interior of the storage container; and pivoting the arm and the storage container about an immobile pivot axis upwardly and into the overhead storage area to change an orientation of the storage container, the wall of the interconnected walls of the storage container becoming upright and blocking access to the interior of the storage container, the storage container positioned at a distance from the rear upright wall corresponding to a stored position of the storage container, the distance from the rear upright wall corresponding to the stored position being less than the distance from the rear upright wall corresponding to the accessible position.

19. The method of claim 18, wherein loading the items in the storage container includes loading the items in the storage container while it is front of a lower structure disposed beneath the overhead storage area.

20. An overhead storage unit, comprising:

an overhead storage area delimited by a ceiling, a floor and upright walls, a rear upright wall of the upright walls defining a rear boundary of the overhead storage area;

a pivot arm extending from a first end to a second end, the first end pivotably mountable to an immobile pivot and the pivot arm pivotable about a pivot axis defined by the pivot; and a storage container having interconnected walls defining a storage container interior, one of the interconnected walls being a first wall, the storage container mounted to the second end of the pivot arm and pivotable with the pivot arm to be raised and lowered between a stored position and an accessible position, the pivot arm forming at least part of one of the interconnected walls;

in the stored position, the storage container is disposed within the overhead storage area and the first wall is upright, the storage container positioned at a first distance from the rear upright wall; and in the accessible position, the storage container is disposed below the overhead storage area and the first wall provides access to the storage container interior, the storage container positioned at a second distance from the rear upright wall greater than the first distance.

* * * * *